US009422034B2

(12) United States Patent
Bauer et al.

(10) Patent No.: US 9,422,034 B2
(45) Date of Patent: Aug. 23, 2016

(54) ACTIVELY STEERABLE GRAVITY EMBEDDED ANCHOR SYSTEMS AND METHODS FOR USING THE SAME

(71) Applicant: InterMoor Inc., Morgan City, LA (US)

(72) Inventors: Thomas C. Bauer, Bellaire, TX (US); Kenneth A. Ullrich, Katy, TX (US); Michael J. Covello, Houston, TX (US)

(73) Assignee: Intermoor Inc., Morgan City, LA (US)

( * ) Notice: Subject to any disclaimer, the term of this patent is extended or adjusted under 35 U.S.C. 154(b) by 0 days.

(21) Appl. No.: 14/669,505

(22) Filed: Mar. 26, 2015

(65) Prior Publication Data

US 2015/0274261 A1 Oct. 1, 2015

Related U.S. Application Data

(60) Provisional application No. 61/971,462, filed on Mar. 27, 2014.

(51) Int. Cl.
*B63B 21/26* (2006.01)

(52) U.S. Cl.
CPC ..... *B63B 21/26* (2013.01); *B63B 2021/265* (2013.01)

(58) Field of Classification Search
CPC ..... B63B 21/26; B63B 2021/265
USPC ..... 701/21
See application file for complete search history.

(56) References Cited

U.S. PATENT DOCUMENTS

| | | | |
|---|---|---|---|
| 3,611,974 | A | 10/1971 | Joppa et al. |
| 3,946,695 | A | 3/1976 | Isaak |
| 4,315,326 | A | 2/1982 | Chase, Jr. |
| 4,587,918 | A | 5/1986 | Burg |
| 4,704,982 | A | 11/1987 | Sahlberg |
| 4,831,952 | A | 5/1989 | Dulhunty |
| 6,106,199 | A | 8/2000 | Medeiros, Jr. et al. |
| 6,598,555 | B1 | 7/2003 | Bruce |
| 6,941,885 | B2 | 9/2005 | Zimmerman et al. |
| 6,983,714 | B2 | 1/2006 | Dove et al. |
| 7,059,263 | B1 | 6/2006 | Zimmerman |

(Continued)

OTHER PUBLICATIONS

Zimmerman, "New Gravity Installed Anchor Requires Less Soil Penetration", Offshore, 2007, 2 pgs.

(Continued)

*Primary Examiner* — McDieunel Marc
*Assistant Examiner* — James E Stroud
(74) *Attorney, Agent, or Firm* — Egan, Peterman, Enders & Huston LLP.

(57) ABSTRACT

Methods and apparatus are disclosed for a self-directed (i.e., autonomous), steerable gravity-embedded anchor. This anchor free-falls through the water column, accelerates due to gravity and uses its kinetic energy to embed itself into the seafloor so as to function as an anchor for mooring of both floating vessels and other underwater structures. Unlike existing gravity-embedded plate anchors, this device can steer itself to its intended target location on the seafloor, enhancing placement accuracy and allowing release directly from an installation vessel on the water surface, thereby greatly simplifying installation.

41 Claims, 18 Drawing Sheets

(56) References Cited

U.S. PATENT DOCUMENTS

| | | | |
|---|---|---|---|
| 2002/0178990 | A1 | 12/2002 | McBride et al. |
| 2004/0123788 | A1 | 7/2004 | Komura et al. |
| 2005/0166825 | A1 | 8/2005 | Zimmerman et al. |
| 2008/0141922 | A1 | 6/2008 | Muehlner |
| 2012/0067268 | A1 | 3/2012 | Guerrero et al. |
| 2013/0160694 | A1 | 6/2013 | Lieng |

OTHER PUBLICATIONS

Zimmerman et al., "A New Direction for Subsea Anchoring and Foundations", available prior to the Mar. 27, 2014 filed of U.S. Appl. No. 61/971,462 to which the current application claims priority, 36 pgs.

International Search Report, PCT/US15/22719, Jul. 1, 2015, 2 pgs.

Mather, "How JDAM Bombs Work", CBS, Mar. 2003, 2 pgs.

ACTIVELY STEERABLE GRAVITY EMBEDDED ANCHOR SYSTEMS AND METHODS FOR USING THE SAME

The present application claims priority to U.S. Provisional Patent Application Ser. No. 61/971,462 filed Mar. 27, 2014 and entitled "ACTIVELY STEERABLE GRAVITY EMBEDDED ANCHOR SYSTEMS AND METHODS FOR USING THE SAME" by Bauer et al., the disclosure of which is incorporated herein by reference in its entirety.

FIELD OF THE INVENTION

This invention relates generally to systems and methods for mooring drilling vessels and other types of vessels.

BACKGROUND

High performance anchors used to moor sea surface vessels and other structures need to be embedded into the seafloor a sufficient depth in order to develop the required holding capacity. Two general methods have been developed over time for this purpose, to wit, drag-embedment and direct-embedment techniques. The method of drag-embedment involves either hauling-in or horizontal movement of the top of the mooring line such that the anchor attached to the lower end of the mooring line is moved horizontally; the anchor is designed such that horizontal movement causes the anchor to dive below the seafloor. The anchor will cease diving below the seafloor when an equilibrium between its holding capacity and the mooring line tension is reached. Methods of direct-embedment of anchors to their final penetration depth include the use of gravity, ballistics, hammers (impact and vibratory) and suction. Gravity has been used to accelerate anchors in free-fall and to force them into the seafloor with gravity followers. Ballistic anchors use a propellant to penetrate the anchors into the seafloor while suction is used in conjunction with suction pile (or suction follower) outfitted with a plate anchor at its tip. The suction follower in the latter case is only an installation tool and is removed after embedding the anchor to final penetration depth. In a similar manner, anchors can be embedded using an impact or vibratory hammer in place of the suction force. There are also hybrid techniques that use combination of free-fall to an initial shallow direct-embedment depth followed by drag-embedment to the final design penetration depth.

Current gravity-embedment techniques deploy a free-fall anchor from a pre-determined height above the seafloor and use the momentum of the falling anchor to adequately embed the anchor into and below the seafloor. Often a deployment height above the seafloor is used that will allow the anchor to reach terminal velocity before penetrating the seafloor. In general, this height is 50 to 150 meters above the seafloor; in deep water it can take a significant period of time to rig the anchor and orient it above the target location.

Gravity-embedded anchors that have been employed in the past have included free fall anchors that glide down at an angle to the seafloor in lieu of dropping relatively straight down to the seafloor. In some current configurations, gravity-embedded anchors are used that look much like darts or torpedoes. An exception to the free-fall anchor type is an anchor that uses a so-called flexible gravity follower to slowly push the plate anchor mounted on the follower tip to final penetration depth by means of the follower's dead weight only. Conventional gravity-embedded free-fall anchors are passively-stabilized with fixed and non-movable stabilizing fins.

SUMMARY OF THE INVENTION

Disclosed herein are actively steerable gravity-embedded anchor systems and methods of using the same that may be employed to actively control or steer the descent path of a falling gravity-embedded anchor. The steerable gravity-embedded anchors of the disclosed systems and methods may be provided with an embeddable anchor body and one or more active and controllable steering system components in order to control or otherwise alter the orientation and/or angle of descent of a steerable gravity-embedded anchor in real time as it falls through the water toward the seafloor. Examples of such steering system components include, but are not limited to, movable control surfaces (e.g., such as rudders, elevators, ailerons, etc.) that may be manipulated in real time between different positions, thrusters (i.e., water jets) that may be selectably activated in different directions and/or manipulated to vector thrust in different directions, motors or actuators or other suitable component/s that are configured to induce gyroscopic forces to rotate the anchor body as it falls to the seafloor, etc.

In any case, the disclosed steerable gravity-embedded anchor systems may be operated to actively steer a falling anchor in contrast to conventional non-steerable gravity-embedded free-fall anchors that are provided with fixed and non-movable stabilizing fins that only act to passively stabilize the downward path of a free falling gravity-embedded anchor without actively controlling the anchor descent path or trajectory. Moreover, the disclosed steerable gravity-embedded anchor systems may be configured for direct deployment from the stern of an Anchor Handling Vessel (AHV) in a manner that substantially avoids the complicated and time consuming rigging required to install conventional gravity-embedded anchors, i.e., current conventional systems can be more complicated as they may require two vessels for installation, or another line in addition to the lowering line for release of the anchor above the seafloor; and can be more time consuming as the anchor must be lowered to a point 50 to 150 meters above the seafloor for release, and the lowering line recovered, all at the anchor winch deployment rate which is substantially slower than the free-fall rate of disclosed steerable gravity-embedded anchor systems. This in turn provides an economic advantage that may be particularly important when mooring in deep water.

In one exemplary embodiment, a steerable gravity-embedded anchor may be provided as a self-directed gliding anchor that is provided with an embeddable anchor body having an on-board and self-contained control system that is configured to steer the embeddable anchor body to a target on the seafloor during anchor free-fall. The on-board control system may include navigation equipment (e.g., such as one or more on-board GPS-based sensors configured to monitor and establish the location of an initial anchor release position on the surface, on-board inertial sensors that are configured to monitor the downward trajectory of the anchor toward the seafloor once it is released to fall through the water, and/or on-board electronic compass/es configured to monitor north-south orientation of the anchor) and steering system components (e.g., movable control surface/s and/or thruster/s) that may be controlled by one or more processing devices and drivers to alter the anchor's trajectory in response to the real time monitored downward trajectory of the anchor as it falls in order to self-direct or autonomously steer the anchor in an autonomous manner to a target location on the seafloor as the anchor falls through the water. In such an embodiment, autonomous steering of the anchor body may be employed during free-fall of the anchor body to improve anchor placement with respect to a design target location on the seabed, e.g., by altering the path of the anchor to the seafloor to account for sub-surface currents and other anomalies. In one exemplary embodiment, the on-board control system may be activated/initialized on the surface (e.g., aboard an anchor handing vessel "AHV" or other type release vessel) prior to releasing the anchor to free fall to the seafloor.

In those embodiments employing movable control surfaces, an anchor body of a steerable gravity-embedded anchor system may be provided with one or more on-board actuators (e.g., electro-mechanical, hydraulic, pneumatic, etc.) that are configured and coupled to control one or more movable control surfaces provided in or on the anchor body. In one such embodiment, the on-board control surfaces of the anchor system may be optionally coupled to one or more fixed non-movable stabilizing fins that are themselves mechanically coupled to the anchor body. In those embodiments employing thrusters (e.g., impellers, propellers, etc.), an anchor body of a steerable gravity-embedded anchor system may be provided with one or more on-board motors (e.g., electro-mechanical, hydraulic, pneumatic, etc.) that are configured and coupled to actuate the thrusters, e.g., by rotating impellers, propellers, etc. In other embodiments, fixed non-movable stabilizing fins may be provided on an anchor body that are separate from the steering system components, e.g., separate from the movable control surfaces, thrusters, etc.

In one exemplary embodiment, the initial surface release location of a steerable anchor system may be directly above the target location on the seafloor prior to release of the anchor. In such an embodiment, an on-board navigation system of the anchor system may be tasked with using the on-board steering system components to maintain a direct path for the anchor to the target location on the seafloor, and to counteract forces attempting to cause the anchor to deviate from the target location as it falls. In such an embodiment, the on-board navigation system does not need to be capable of determining its absolute location (e.g., longitude and latitude) and may be, for example, an inertial guidance system that does not know its absolute location. Rather, marine positioning equipment (e.g., such as differential global positioning system "DGPS" and/or long range navigation "LORAN") may be optionally employed to ensure the release vessel is located over the target location prior to anchor deployment. However, in another exemplary embodiment, an on-board navigation system may be provided that is capable of sensing absolute location of the anchor (e.g., such as GPS) may be used to allow the initial surface release location of a steerable anchor system to be offset from the target location, as long as the positional offset between the anchor location and target location is within the controllable glide envelope of the on-board steering system components.

It will be understood that the disclosed steerable gravity-embedded anchor systems may be implemented with an embeddable anchor body of any configuration that is suitable for embedment within a seafloor. For example, in one exemplary embodiment, a steerable gravity-embedded anchor system may be configured with an embeddable anchor body that is physically dimensioned similar to a conventional plate anchor (i.e., flat). In such an embodiment, the embeddable anchor body may be provided with integral control surfaces, or stabilizing fins in combination with control surfaces. As an example, one possible steering system configuration for a plate anchor body may include movable control surfaces in the form of a pair of ailerons positioned on the trailing edge of the fluke of the anchor body. In such a configuration, pitch of the anchor may be controlled directly, and the yaw direction may be changed by first rolling the anchor. In an alternate configuration, a non-movable vertical stabilizer with a movable rudder surface may be provided, in which case both pitch and yaw can be controlled directly.

In another exemplary embodiment, a steerable gravity-embedded anchor system may be configured with an embeddable anchor body that is physically dimensioned similar to a conventional torpedo pile, i.e., an elongated cylinder with stabilizing fins near the leading and/or trailing ends of the main body or, potentially, both ends. In such a configuration, movable control surfaces may be coupled to the trailing edges of one or more of the stabilizing fins.

Using the disclosed systems and methods, the anchor body of a steerable gravity-embedded anchor system may be configured to reach its final design penetration depth/distance in the seafloor by gravity-embedment alone, by a combination of gravity-embedment and drag-embedment, or by any other suitable embedment technique or operation. In one exemplary embodiment, a drag-embedment phase for a steerable anchor body may be accomplished by attaching a mooring line to the anchor's mooring pendant line and tensioning the mooring line to cause the anchor to penetrate further into the seafloor.

In a further embodiment, the same navigational data processed from the on-board navigation system (e.g., on-board inertial and inclination sensors) to steer an anchor body in its flight from the anchor drop point to the seafloor may also be retrieved and used to provide an interim or final penetration depth and orientation for the anchor body below the seafloor. Such navigational data may be retrieved in real time or from memory from an on-board control system of a steerable anchor system in any suitable manner after the steerable anchor body has been at least partially embedded in to the seafloor.

In one exemplary embodiment, stored or real time post-embedment navigational data (e.g., including anchor position and orientation data) may be transmitted electrically through a data transmission path of a suitably-configured anchor recovery line or retrieval pendant (e.g., such as a so-called synthetic mud rope) from the steerable anchor control system to a floating recovery buoy configured with one or more processing device/s, memory, and other electronic components that are configured with circuitry to transmit or re-transmit the received navigational data (e.g., as optical or acoustic signals) to data retrieval circuitry provided within a remotely operated vehicle (ROV). In this regard, data retrieval circuitry of the ROV may include communication modem circuitry or other type of suitable acoustic or optical sensor/s coupled to a corresponding acoustic or optical receiver that is configured to receive, decode and/or demodulate, the navigation data signals transmitted to the ROV by the recovery buoy, as well as one or more processing devices and memory configured to process and/or store the received navigation data on-board the ROV. Circuitry on board the ROV may in turn be configured to communicate the navigation data or visual camera images in real time to a computer terminal (e.g., notebook computer, desktop computer, tablet computer, smart phone, or other suitable computer device) on an AHV or other attached surface vessel via available empty channels of the ROV umbilical. Alternatively, the ROV may be provided with data logger memory configured to store the received navigation, in which case the stored data may be directly retrieved from the ROV memory upon return to the surface.

A recovery buoy may be configured in one exemplary embodiment as a remote input/output device for the anchor control system, such that the ROV may query and receive real time or stored navigational data from the anchor control system through a visual or acoustic I/O interface (e.g., optical sensor and transmitter, acoustic modem, graphical display device, optical modem, acoustic modem etc.) provided on the recovery buoy. In yet another embodiment, a recovery buoy may be configured with its own data logger memory to store the navigational data received from the anchor control system, e.g., for later transmittal to a ROV. It is also possible that at least a portion of the recovery buoy may be physically detachable from the recovery line after it has stored the navigational data in on-board memory of the recovery buoy, in which case the ROV may physically detach and retrieve at least a portion of the recovery buoy containing the stored navigation data in memory and bring the stored navigational data to the surface where it may be downloaded from the buoy.

To facilitate transmission of navigational data from the anchor control system to the floating recovery buoy, a recovery line or retrieval pendant may in one embodiment be configured as a mud rope may having a suitable data transmission media or data link (electrically-insulated conductor/s for electrical data path, fiber optic conductor/s for optical data path, etc.) that extends through the recovery line or retrieval pendant (e.g., that is woven or threaded through the mud rope) between the anchor system and the recovery buoy to couple the anchor control system in data communication with the recovery buoy circuitry. In such a case, the recovery line or retrieval pendant and floating recovery buoy may be attached to the anchor system at the surface and dropped with the steerable anchor to the seafloor with the recovery line and recovery buoy trailing behind the anchor system. The recovery line may be provided in one embodiment as a mudrope that is neutrally buoyant to allow a relatively small recovery buoy to be employed. The recovery line may also be of any suitable length, but in one embodiment may have a length that is selected such that the recovery buoy floats high above the mudline when the anchor system is partially embedded in the seafloor, and such that the recovery buoy floats relatively close above the mudline when the anchor system is fully embedded in the seafloor. In either case, the ROV may approach the recovery buoy to query the recovery buoy circuitry and/or to query the control system in the anchor body through the recovery buoy circuitry. During this process, the ROV may grab the buoy or just hover nearby.

In one exemplary embodiment, post-embedment navigational data may be visually retrieved from the recovery buoy after anchor embedment, e.g., by a ROV. In such an embodiment, a recovery line supporting a data transmission media may be provided with a floating recovery buoy having an integral and waterproof visual display device (e.g., LED display, LCD display, etc.) that is configured to receive and display information representative of the post-embedment navigation data from the steerable anchor system through the suspended data transmission media. After anchor embedment, the end of the recovery line and recovery buoy may extend from the anchor to float above the seafloor, such that the video display device is in a position to display anchor penetration (e.g., anchor depth, anchor orientation, etc.) where it may be read, e.g., by a ROV, by a diver, etc. In one exemplary embodiment, a ROV may approach the recovery buoy and flash its onboard ROV lights at the buoy. The recovery buoy may be provided with an optical sensor or photo sensor to allow circuitry within the recovery buoy (or the control system within the anchor system) to sense the flashed ROV lights. The recovery buoy and/or control system circuitry may be configured to respond to the ROV lights by activating the control system to display anchor installation/penetration information (e.g., depth and orientation information of the embedded anchor system) visually on the integral buoy display screen. The ROV may then read the displayed data with its standard onboard cameras, and transmit or otherwise retrieve these images to a surface vessel. This visual data retrieval technique may be implemented in one embodiment in a robust and relatively inexpensive manner.

In another exemplary embodiment, direct hardwire data connection may be made between a ROV and a recovery buoy, e.g., by using suitable mating subsea electrical or fiber optic data connectors/plugs. In such an embodiment, a ROV-side data connector may be retrieved from the recovery buoy by the ROV, and temporarily connected to a suitable mating data connector provided on the ROV for data retrieval. Alternatively, a ROV-side connector may be mounted in the recovery buoy itself for connection to the ROV circuitry.

In another exemplary embodiment, stored post-embedment navigational data may be physically retrieved together with the control system circuitry, e.g., by a ROV. In such an embodiment, collected navigational data may be stored in data logger memory of a retrievable control system capsule (e.g., that includes non-volatile memory such as Flash memory module/s) that may be mounted by detachable data interconnect inside the steerable anchor system. A lanyard or other suitable capsule retrieval line (e.g., optionally having a relatively small attached floating capsule recovery buoy) may be attached to the retrievable control system capsule that is contained within the steerable anchor system such that the end of the lanyard and its optional capsule recovery buoy extend from the anchor to float above the seafloor after anchor embedment. Such a capsule retrieval line may be a separate line from an anchor mooring pendant and recovery line, which may also be present. The control system capsule may be physically detached from the embedded anchor (e.g., at a detachable interconnection point) and recovered after anchor embedment, e.g., by using a ROV to pull on the lanyard that runs from the anchor to the capsule recovery buoy floating above the seafloor. The control system capsule with data logger module may then be brought to the surface by the ROV, where the navigational data may be read from memory of the data logger.

In one respect, disclosed herein is a method for installing one or more anchor systems in a seafloor underlying a body of water. The method may include first deploying at least one steerable anchor system into the water from an installation vessel on the water surface. The deployed steerable anchor system may include: an embeddable anchor body, one or more steering system components, and an on-board control system having at least one processing device coupled to control the steering system components. The method may further include releasing the steerable anchor system to free fall through the water toward the seafloor; and then using the on-board control system to control the steering system components to alter the descent path of the anchor system to steer the anchor system to a target location on the seafloor.

In another respect, disclosed herein is a steerable anchor system, including: an embeddable anchor body, one or more steering system components, and an on-board control system having at least one processing device coupled to control the steering system components.

DESCRIPTION OF ILLUSTRATIVE EMBODIMENTS

FIGS. 1A, 1B, 1C, 1D and 1E illustrate multiple respective views of one exemplary embodiment of an autonomous steerable gravity embedded anchor system 100. In this embodiment, anchor system 100 is illustrated as plate anchor having two active movable control surfaces 105A and 105B that are hingeably coupled to the trailing edge of flukes 104A and 104B of the anchor body of system 100. However, it will be understood that other configurations are possible, including plate anchor configurations having more than two active movable control surfaces 105 coupled to the trailing edge of fluke/s 104 of a plate anchor body. In other embodiments, additional active movable control surfaces may be provided on a plate anchor body, for example a movable rudder hingeably coupled to the trailing edge of center plate 101 and/or small active movable fins for trim purposes placed on the extremities of the flukes 104A and 104B. In other alternate embodiments, different types of anchor bodies may be provided with one or more active movable control surfaces. For example, a steerable anchor system 100 may be provided with an anchor body that is configured similar to a torpedo pile, e.g., having an elongated cylindrical anchor body and fixed (i.e., non-movable) stabilizing fins coupled to the anchor body near the leading and/or trailing ends of the main anchor body, with active movable control surfaces hingeably coupled to the trailing edge/s of one or more of the non-movable stabilizing fins.

Figure 1A:
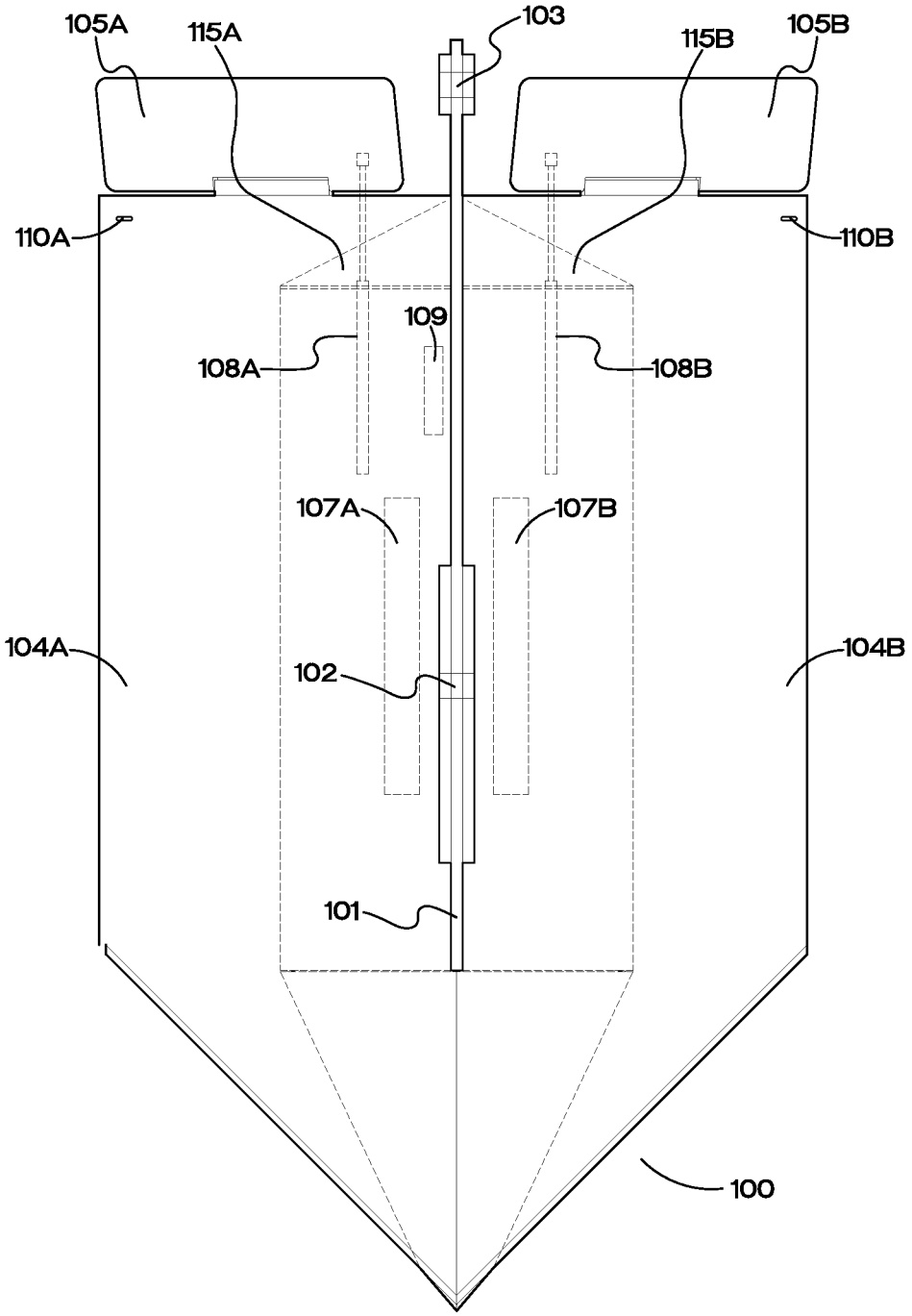
FIG. 1A illustrates an overhead view of an autonomous steerable anchor system according to one exemplary embodiment of the disclosed systems and methods.
Figure 1B:
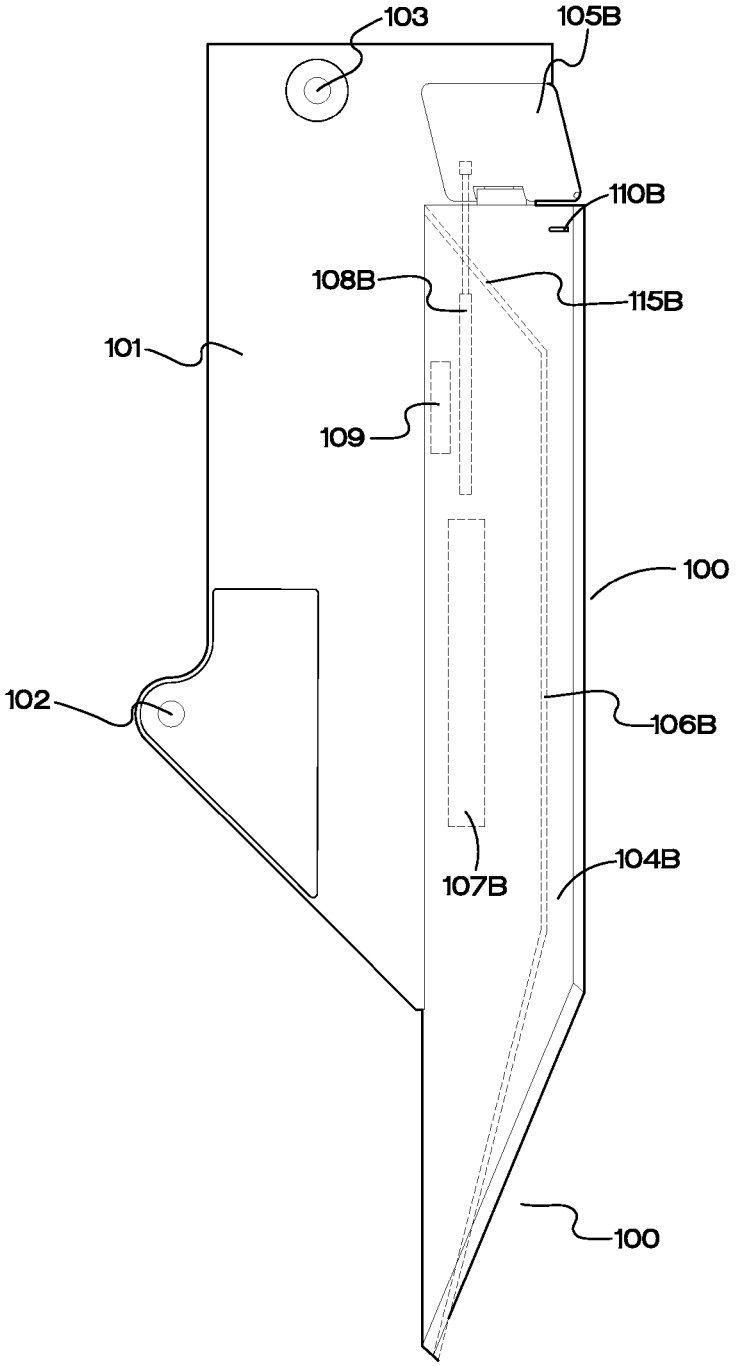
FIG. 1B illustrates a side view of an autonomous steerable anchor system according to one exemplary embodiment of the disclosed systems and methods.
Figure 1C:
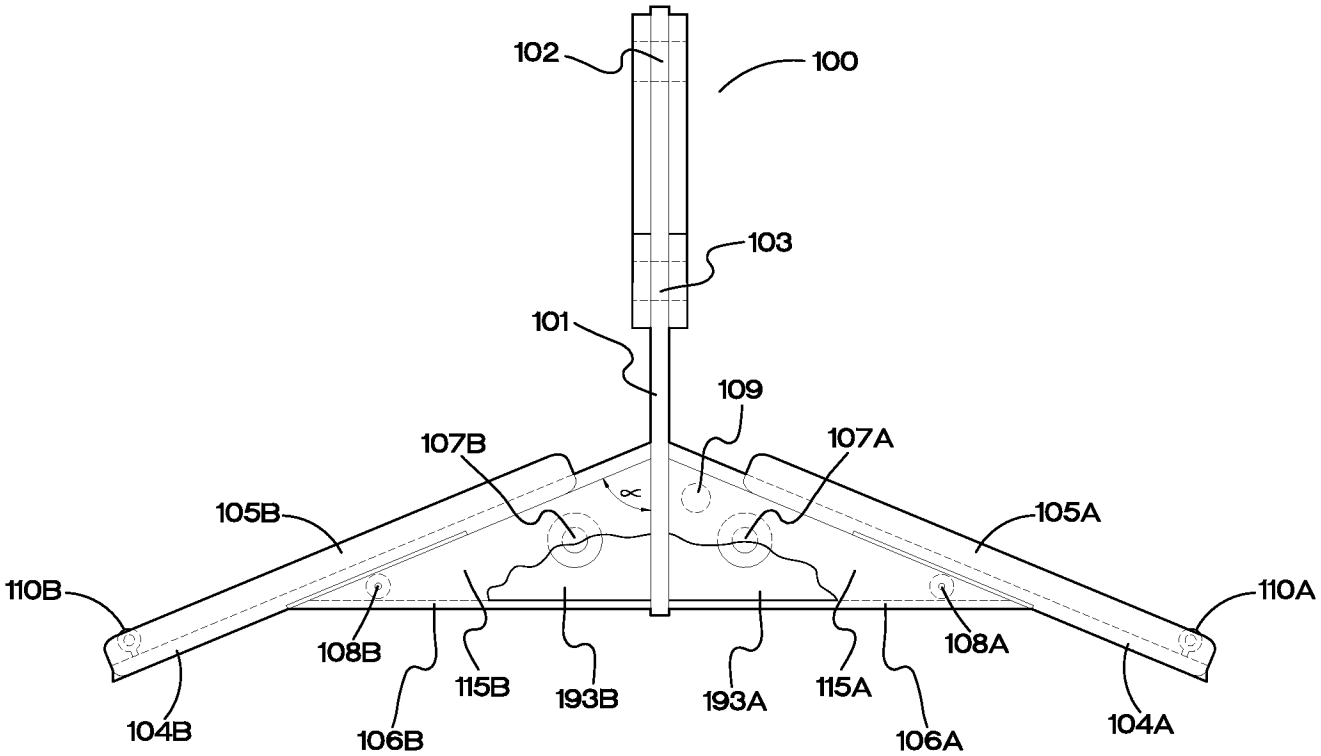
FIG. 1C illustrates a rear end view of an autonomous steerable anchor system according to one exemplary embodiment of the disclosed systems and methods.

In the embodiment of FIGS. 1A, 1B, 1C, 1D and 1E, outwardly-extending flukes 104A and 104B are coupled to also extend outwardly to form a downward anhedral angle of about 20 degrees relative to the horizontal plane normal to the orientation of center plate 101 (i.e., an angle $\alpha$ of about 70 degrees relative to the vertical plane of center plate 101 as shown in FIG. 1C), it being understood that outwardly-extending flukes 104A and 104B may be coupled to extend outwardly from center plate 101 to form any greater or lesser angle $\alpha$ suitable for a given application, for example, in one exemplary embodiment at any angle $\alpha$ from about 60 degrees to about 80 degrees relative to center plate 101 it being understood that angle $\alpha$ may alternatively be greater than 80 degrees or less than 60 degrees in other embodiments. As further shown, in this embodiment vertical center plate 101 extends upward from flukes 104A and 104B to form a vertical stabilizer portion above flukes 104. It will be understood that in other embodiments a center plate 101 may not extend below flukes 104A and 104B, e.g., a center plate 101 may be coupled to extend upward from flukes 104A and 104B as shown, but with no portion of the center plate extending below flukes 104A and 104B.

Also shown in FIG. 1C are horizontal bottom plates 106A and 106B that are coupled between respective flukes 104A and 104B to create right and left anchor system internal cavities 193A and 193B between each respective fluke 104A and 104B and bottom plate 106 as shown in cut-away view in FIG. 1C. End caps 115A and 115B may be further provided as shown in FIG. 1C to close off the rear side of internal cavities 193A and 193B as shown to provide sheltered location/s for electrical and mechanical components of the steerable anchor system 100 that protect the electrical and mechanical components of the steerable anchor system from subsea and subsurface environments, e.g., with any suitable or necessary openings defined through center plate 101 to provide for routing of electrical conductor and/or hydraulic or pneumatic conduits of system 100 between cavities 193A and 193B. In another embodiment where center plate 101 does not extend below flukes 104 (or extends only partially between flukes 104 and a bottom plate 106), then only a single continuous cavity 193 and single bottom plate 106 may be present. It will also be understood, however, that presence of one or more internal cavities 193 is optional, and that in other embodiments the underside of anchor system 100 may be open beneath flukes 104A and 104B, e.g., with no bottom plates 106 and/or end caps 115A and 115B provided.

Figure 1D:
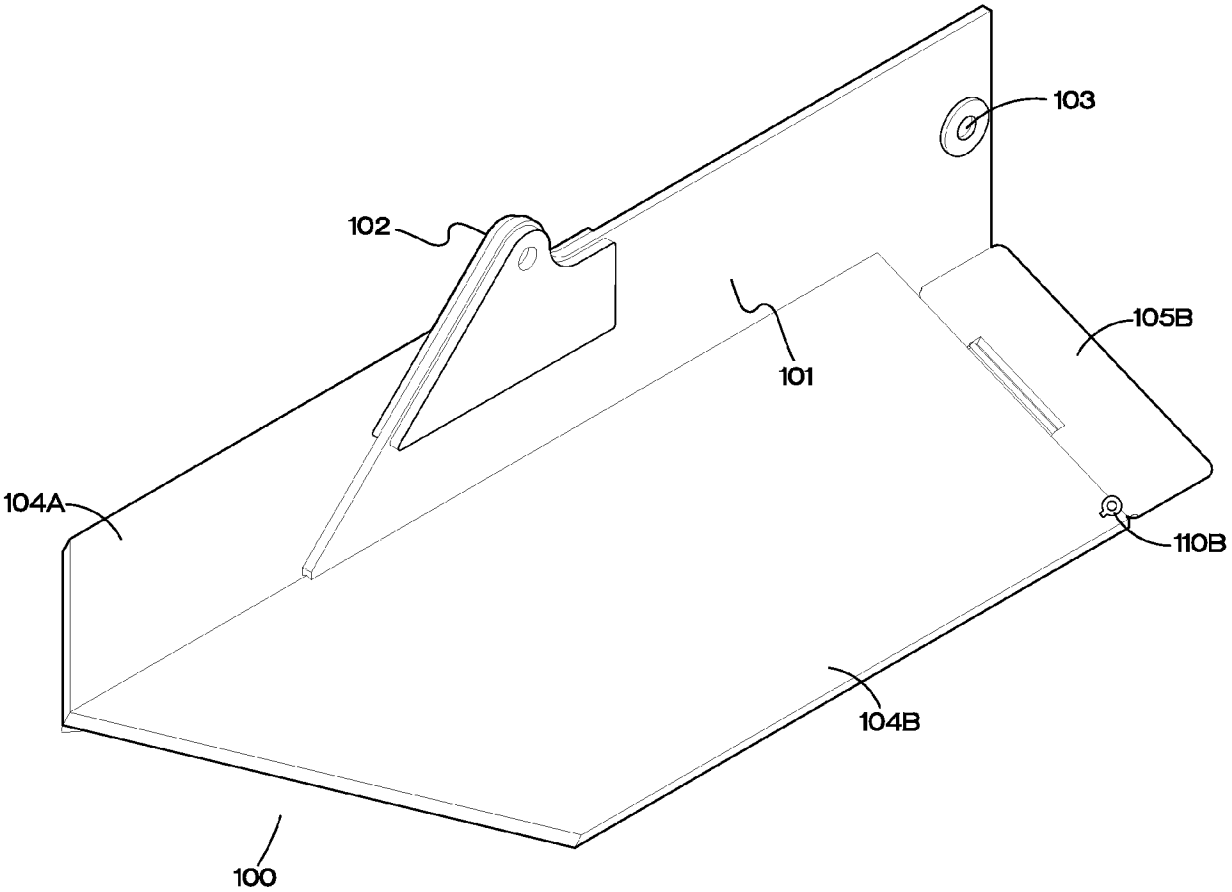
FIG. 1D illustrates a front overhead perspective view of an autonomous steerable anchor system according to one exemplary embodiment of the disclosed systems and methods.
Figure 1E:
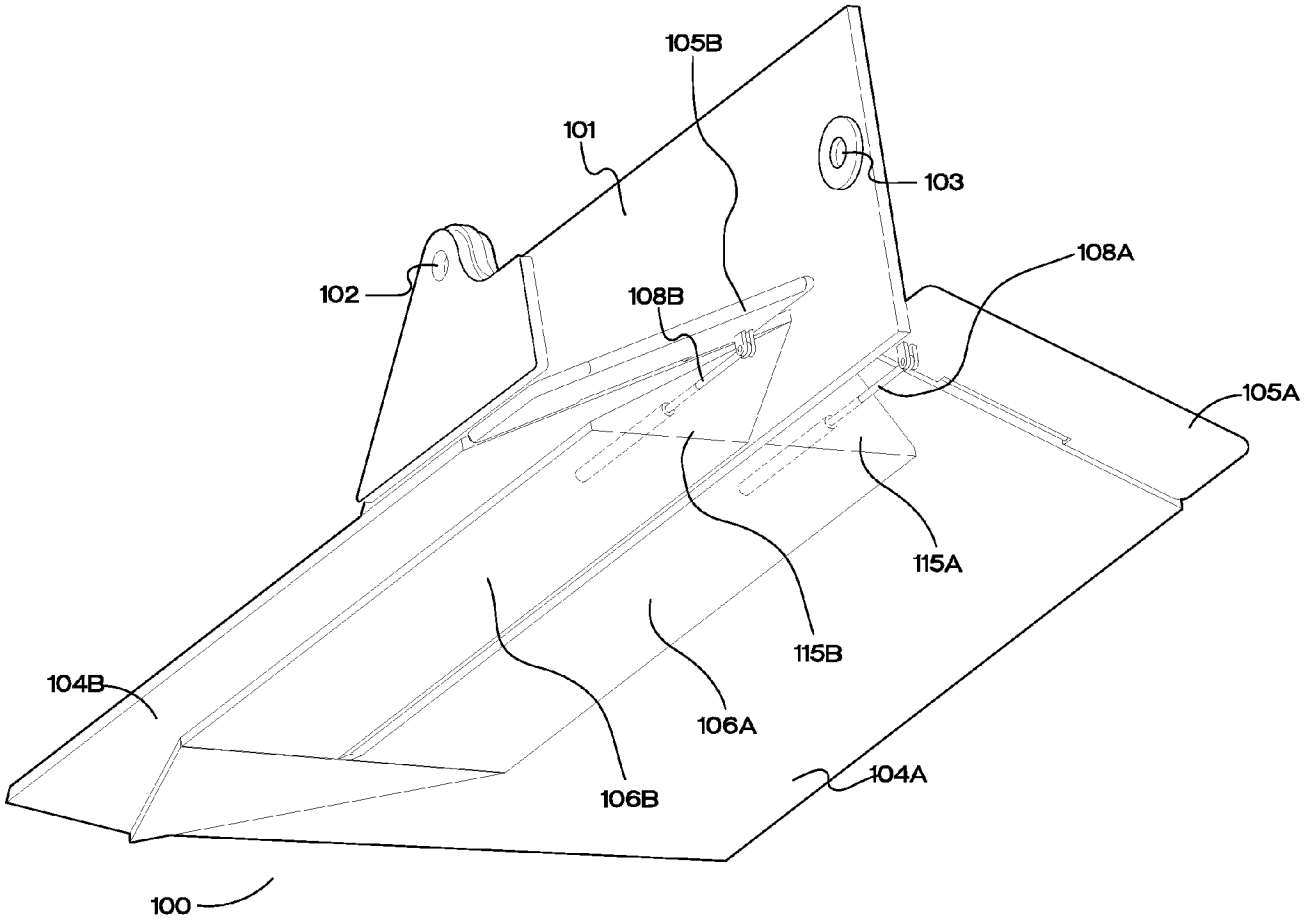
FIG. 1E illustrates a rear underside perspective view of an autonomous steerable anchor system according to one exemplary embodiment of the disclosed systems and methods.

FIG. 1D illustrates a front overhead perspective view of the embodiment of FIGS. 1A, 1B and 1C; and FIG. 1E illustrates a rear underside perspective view of the embodiment of FIGS. 1A, 1B and 1C.

Still referring to the exemplary embodiment of FIGS. 1A-1E, anchor system 100 includes stored energy sources in the form of hydraulic and/or pneumatic accumulators 107A and 107B that are charged pressure vessels containing pressurized fluid/s (e.g., including high pressure gases) are configured to provide the necessary energy to move the control surfaces 105A/105B by actuating the hydraulic or pneumatic pistons and cylinders 108A and 108B that move the control surfaces 105A/105B at the command of internal navigation system component/s optionally contained in capsule 109 which may provide additional protection (e.g., such as waterproofing and/or protection from hydrostatic pressure) for electrical components. In this regard, control surfaces 105A and 105B may be independently actuated or actuated in tandem using custom and/or off-the-shelf electrical, hydraulic and/or pneumatic systems that are all controlled by the internal navigation system components of the control system (e.g., that may be present within capsule 109) via appropriate drivers, and/or or by other control system configuration. In the illustrated embodiment, accumulator 107A and piston/cylinder 108A may be contained within internal cavity 193A, and accumulator 107B and piston/cylinder 108B may be contained within internal cavity 193B. However, in other embodiments, accumulators 107 and piston/cylinders 108 may be mounted in any other suitable manner, e.g., hung from flukes 104 when no internal cavities 193 are provided.

Figure 7:
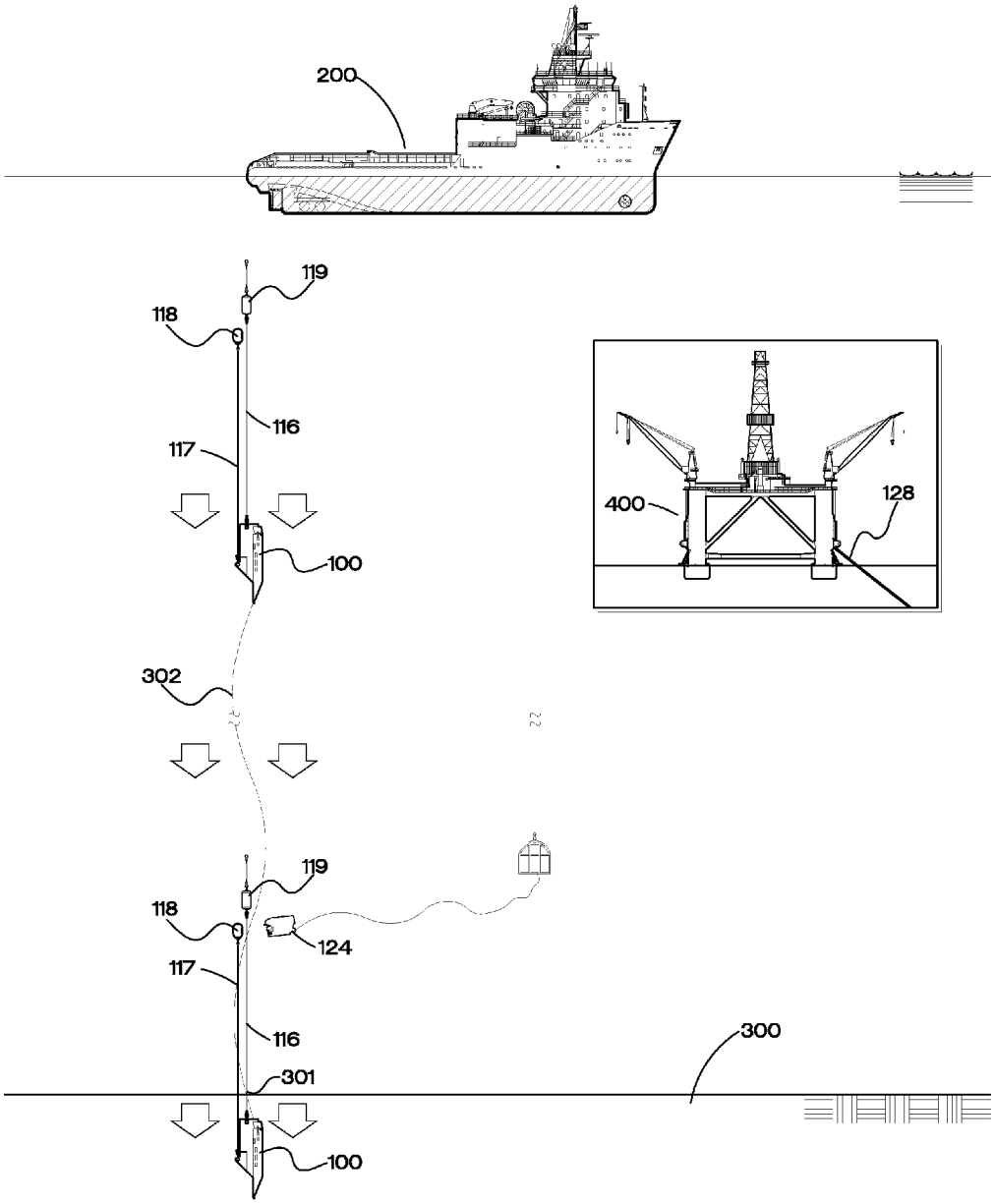
FIG. 7 illustrates descent of a steerable anchor system according to one exemplary embodiment of the disclosed systems and methods.

It will be understood that the particular types of actuators, energy source/s (e.g., accumulator, battery, etc.) may be chosen and configured to fit a given application based on such factors as control time duration, maximum control surface stroke and safety of personnel working near or servicing the anchor's control system, etc. For example, other examples of suitable energy sources include, but are not limited to, combustion reaction chambers charged with components that react to provide pressurized fluid energy, electrically actuated and powered hydraulic pumps or gas compressors, etc. In this exemplary embodiment, a data logger, system drivers and batteries may also be contained within capsule 109 as further illustrated in FIG. 11. Other features shown in FIGS. 1A-1E is an attachment opening in the form of an integral mooring pendant line pad-eye 102 defined through center plate 101, and deck winch attachment loops 110A and 110B. As shown in FIG. 1B, a forward area of center plate 101 may in one embodiment be provided with an upwardly extending portion to raise the position of the mooring pendant line attachment point provided by opening 102 above the remaining aft portion of center plate 101 so as to allow for a greater degree of rotation of a mooring pendant line shackle connected to opening 102 when anchor system 100 is descending through the water as shown in FIG. 7. An optional cheek plate may be provided in one embodiment around opening 102 to provide strength for resisting mooring line tension. It is alternatively possible that more than one opening 102 may be defined in more than one locations of center plate 101 as may be desired or needed for attachment to a mooring pendant line according to a given application.

With regard to the exemplary embodiment of FIGS. 1A-1E, the anchor body of anchor system 100 includes plate anchor elements 101, 104, 106 and 110 to which other components of steerable anchor system 100 have been assembled to form the steerable anchor system 100. Such other components may include, but are not limited to, control surfaces 105, energy sources 107 and actuators 108, together with various control system components as further described herein. With regard to the anchor body of system 100 of FIGS. 1A-1E, it will also be understood that the geometry of the anchor's attachment point (e.g., via mooring pendant line attachment to pad-eye opening 102) with respect to the anchor fluke's center of pressure may be selected to provide the proper angle of attack for the drag-embedment phase to be successful. Alternatively, the angle of the attachment point could be controlled by the ailerons or other control surfaces used to direct the anchor system 100 in the correct dive path beneath the seafloor 300.

Figure 1F:
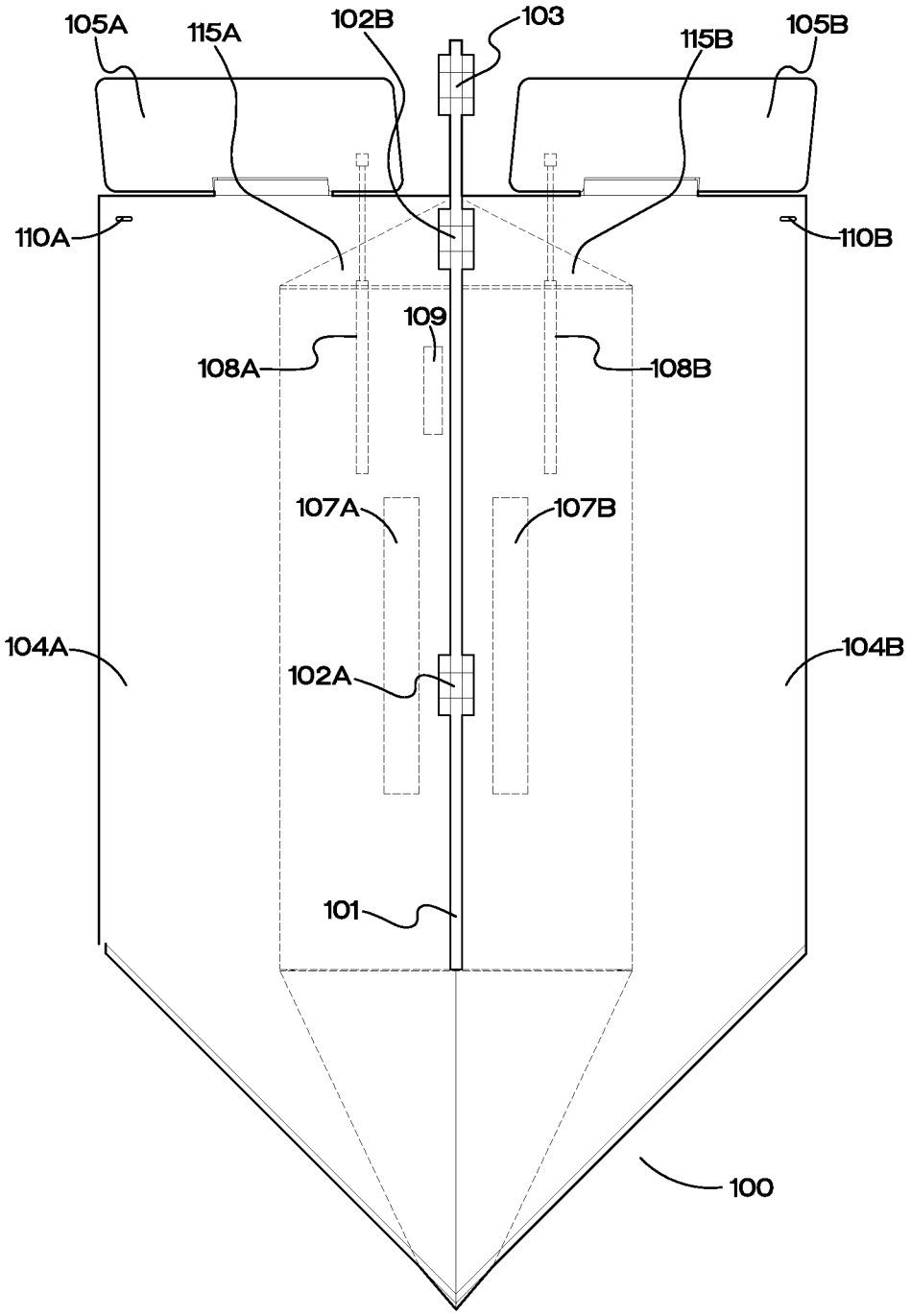
FIG. 1F illustrates an overhead view of an autonomous steerable anchor system according to one exemplary embodiment of the disclosed systems and methods.
Figure 1G:
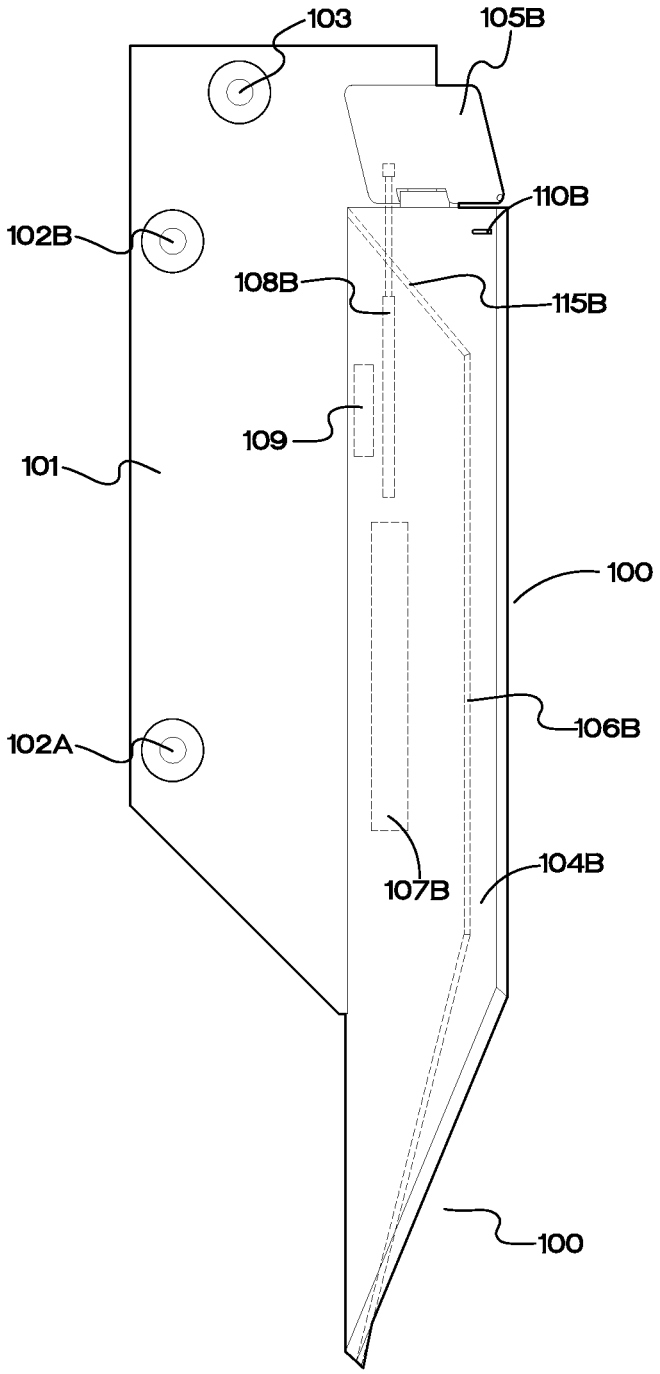
FIG. 1G illustrates a side view of an autonomous steerable anchor system according to one exemplary embodiment of the disclosed systems and methods.

It will be understood that the illustrated exemplary plate anchor embodiment of FIGS. 1A, 1B, 1C, 1D and 1E is exemplary only, and that different configurations are possible in other embodiments, including plate anchor configurations having different number, geometry and/or types of attachment features (e.g., attachment opening/s such as pad-eye/s 102 or other types of attachment features such as threaded openings, mechanical connectors, etc.), having different fluke and/or center plate dimensions/geometry, etc. For example, FIGS. 1F and 1G illustrate respective overhead and side views of another exemplary embodiment of an autonomous steerable gravity embedded anchor system 100. In this exemplary embodiment, attachment openings in the form of mooring pendant bridle attachment pad-eyes 102A and 102B are provided as shown for attachment to respective parts of a mooring bridle and triplate assembly as further illustrated in FIG. 10B. It will be understood that with regard to the embodiment of FIGS. 1F and 1G, the geometry of the anchor's attachment point (e.g., via bridle attachment to pad-eye openings 102A and 102B) with respect to the anchor fluke's center of pressure may be selected to fit the characteristics or needs of a given application, and/or the angle of the attachment point may be set to 90° and ailerons or other control surfaces used to direct the anchor system 100 in the correct dive path beneath the seafloor 300.

Figure 2:
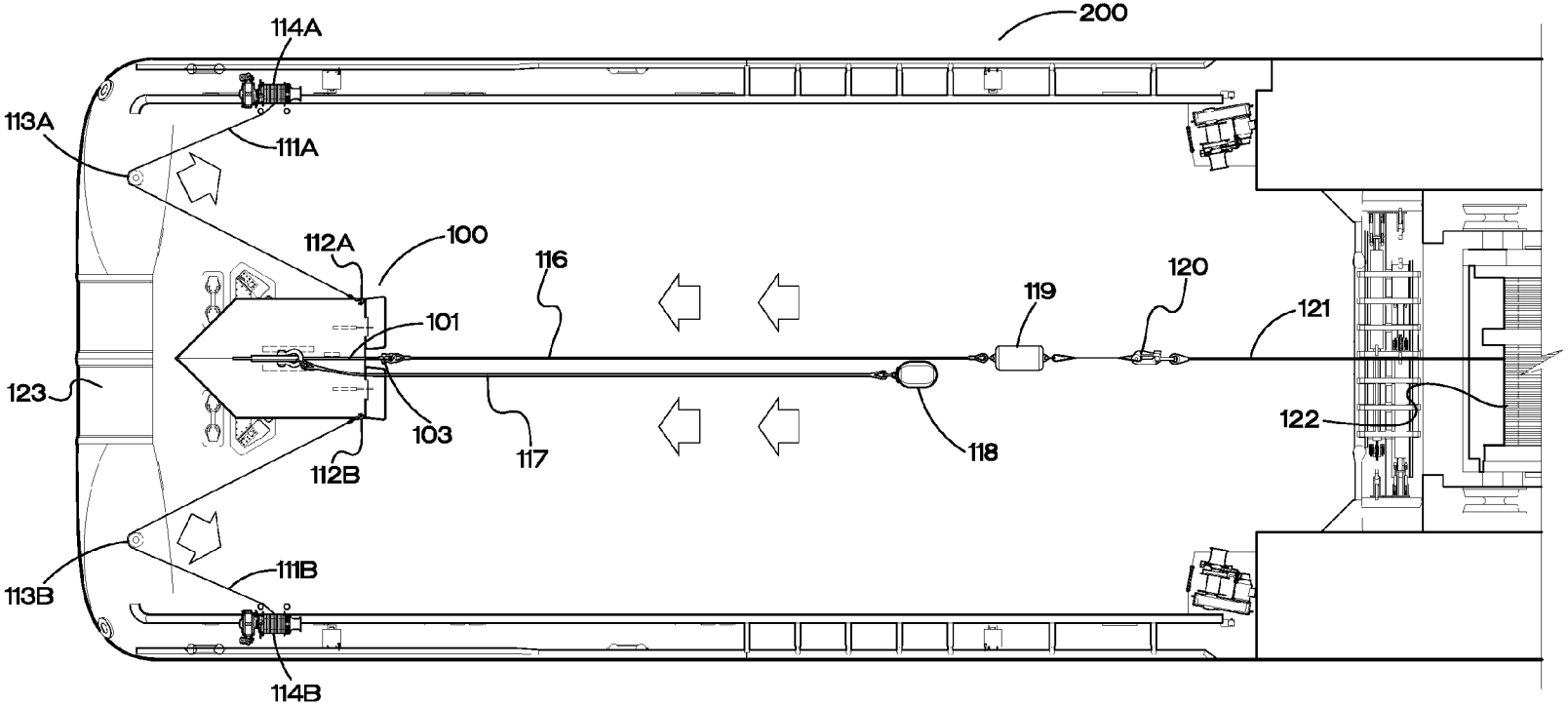
FIG. 2 illustrates in a plan view a steerable anchor system rigged for deployment off the stern of an Anchor Handling Vessel (AHV) according to one exemplary embodiment of the disclosed systems and methods.

FIG. 2 shows the anchor system 100 of FIG. 1 rigged for deployment off the stern of an installation vessel 200; in this embodiment, an anchor handling vessel (AHV). As shown, winch lines 111A and 111B run from deck winches 114A and 114B, around tow pins 113A and 113B and attach to the fluke attachment loops 110A and 110B via hooks 112A and 112B. In this embodiment, hauling in on the deck winches 114A/114B will move the anchor 100 aft onto the stern roller 123. Also shown is mooring pendant line 117 connected to mooring pendant attachment pad-eye 102. In this exemplary embodiment, the upper end of the mooring pendant line 117 is outfitted with a submersible buoy with an integral subsea connector receptacle 118. It will be understood that other subsea connection methods and/or apparatus would be suitable; for example, the use of a subsea ROV hook available from Irizar Forge Lifting & Mooring of Lazkao, Spain; a HK12 "KS Hook" available from GN Rope Fittings B.V. of Nieuwkoop, The Netherlands, etc. Attached to the retrieval line attachment point opening 103 on the trailing edge of the center plate 101, is the recovery pendant line 116. In this illustrated embodiment, pendant line 116 is a synthetic mud rope although other any other suitable line type may be employed. At the upper end of the recovery pendant 116, a small submersible recovery buoy 119 may be attached as shown; this recovery buoy's purpose is to keep the recovery pendant suspended above the seafloor 300 for later recovery of the anchor 100 by means of hauling in of the recovery pendant 116 by the AHV 200. The top end of the buoy 119 may be outfitted with a master link that is part of the anchor 100 pelican hook release device 120. Anchor hold-back during the anchor 100 deployment may be accomplished using the AHV 200's workwire 121 which may be attached as shown to the top of the pelican hook 120. As the deck winches 114A/114B move the anchor 100 towards the stern of the AHV 200, the vessel's main winch 122 deploys the workwire 121, maintaining equilibrium. In the alternative anchor system configuration embodiment shown in FIG. 10B, assembled triplate 126 and mooring bridle parts 127A and 127B may be alternatively connected to the mooring pendant line 117 for deployment of the anchor system 100 off the stern of an installation vessel 200 in a manner similar to that described above.

Figure 3:
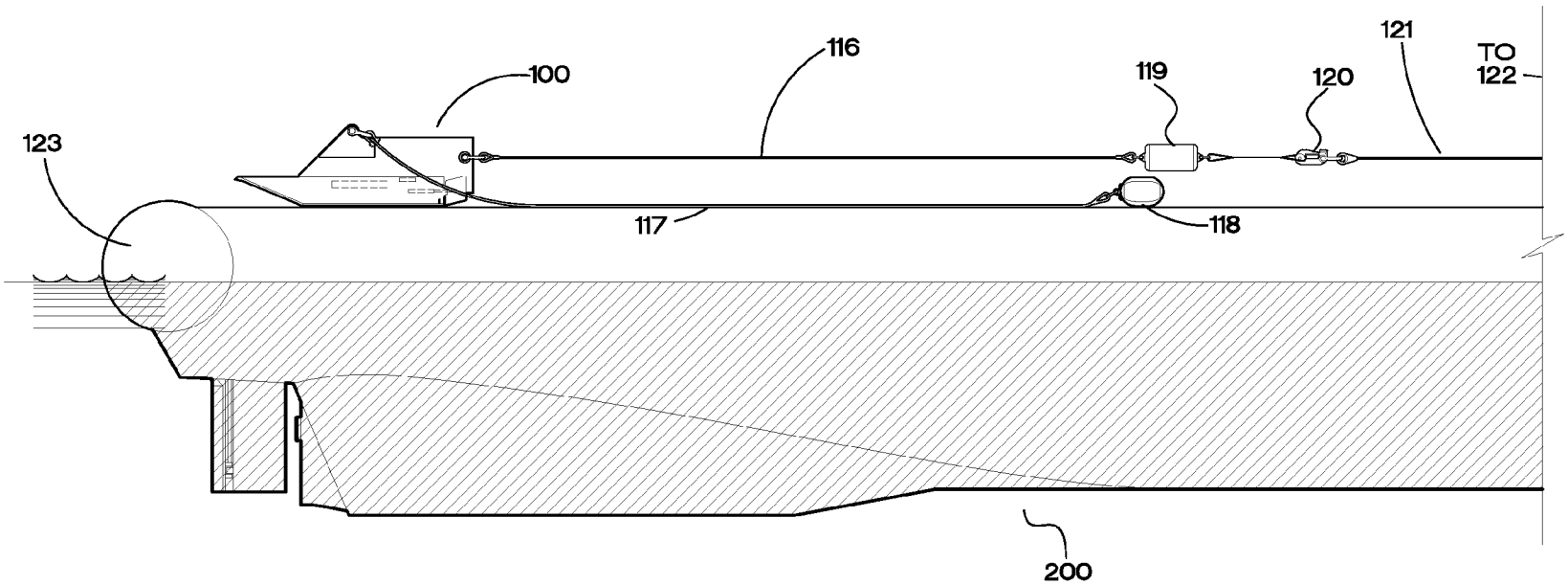
FIG. 3 illustrates in an elevation view a steerable anchor system rigged for deployment off the stern of an Anchor Handling Vessel (AHV) according to one exemplary embodiment of the disclosed systems and methods.

In FIG. 3, the rigging for deployment of anchor system 100 of FIG. 2 is shown in an elevation view. At the point illustrated in FIG. 3, the AHV's stern is located over the target location 301 and the internal control system for the anchor system 100 may be initialized, e.g., by wirelessly docking a laptop computer configured with suitable software to the anchor's internal control system components (e.g., within capsule 109) via radio and initializing the inertial navigation system and/or GPS system. At this point the accumulators 107A/107B are fully charged as are the batteries of the internal control system, e.g., within capsule 109.

Figure 4:
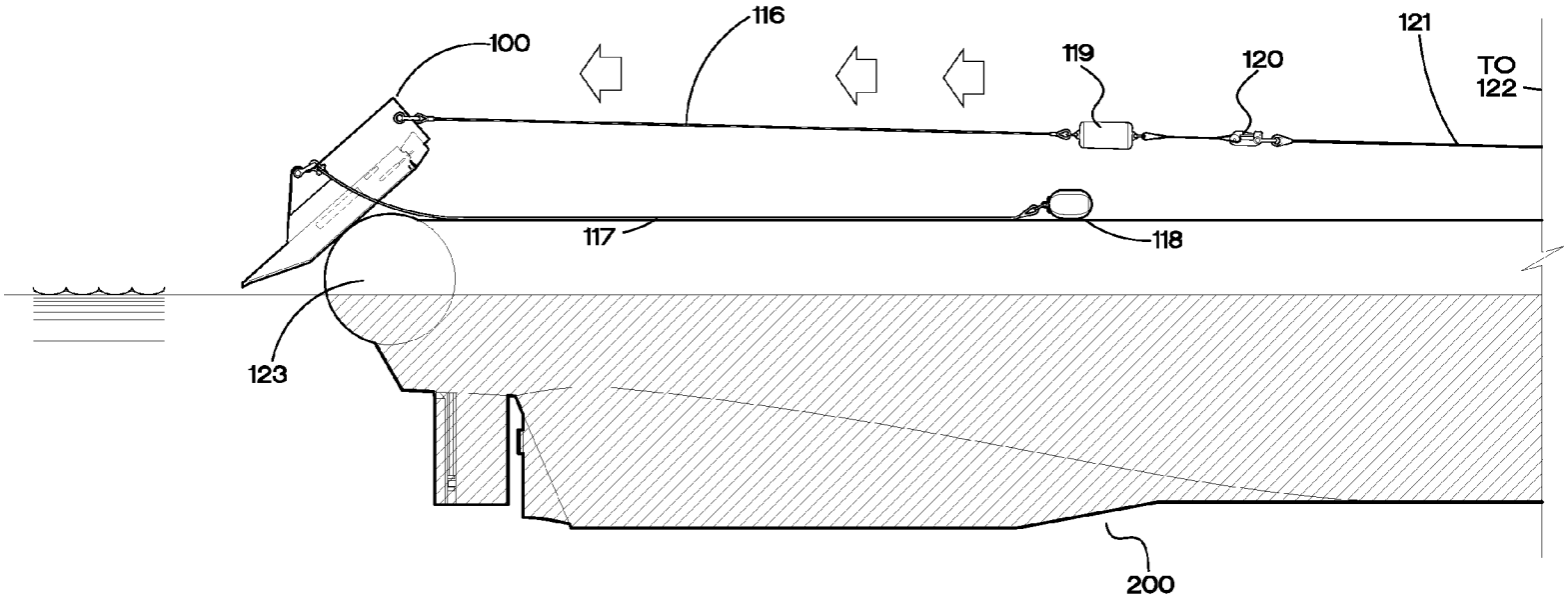
FIG. 4 illustrates a steerable anchor system partially deployed off the stern roller on the AHV according to one exemplary embodiment of the disclosed systems and methods.

In FIG. 4, the anchor system 100 is shown partially deployed off the stern roller 123. This has been accomplished by hauling in on the deck winches 114A and 114B and paying out the workwire 121 on the main winch drum 122. At the point illustrated, the center of gravity of the anchor 100 is outboard of the stern roller 123; from this point onward, the deck winch lines 111A and 111B will no longer be needed for deployment and can be removed from the anchor system 100.

Figure 5:
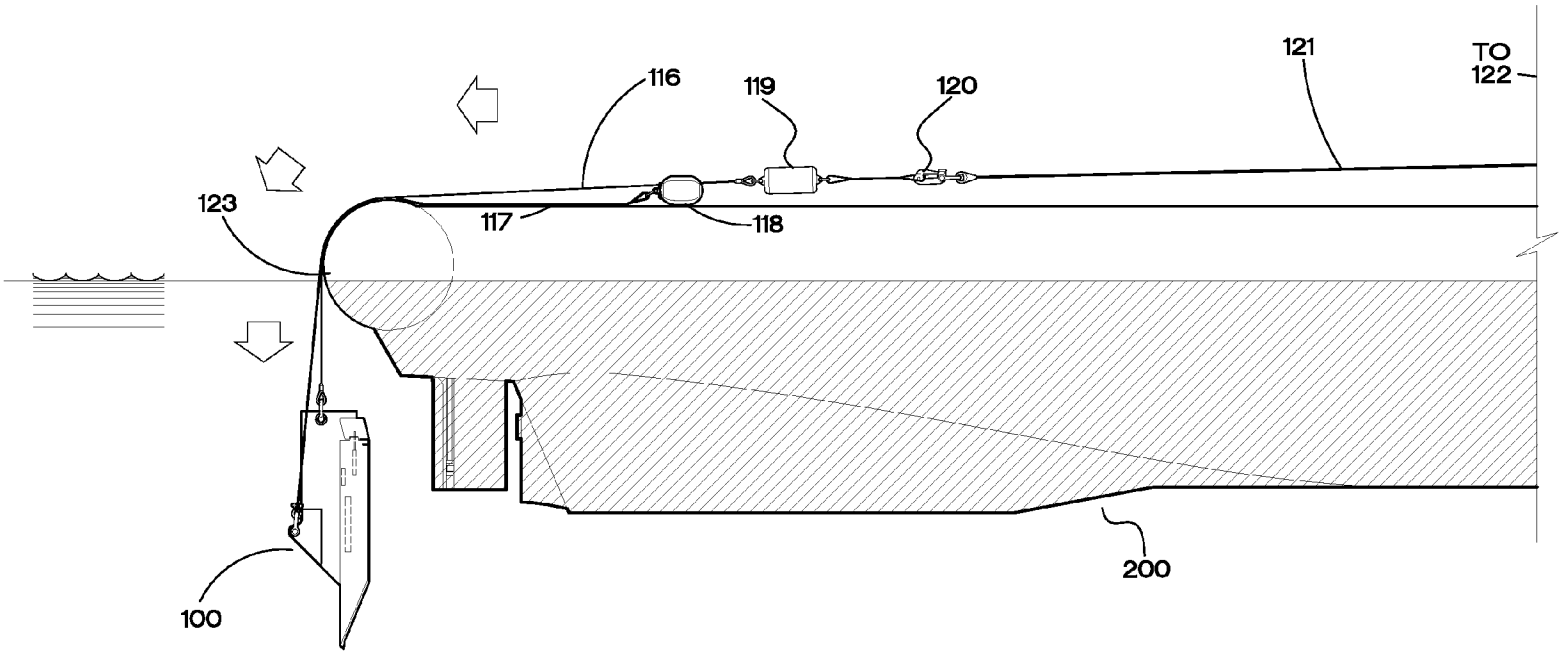
FIG. 5 illustrates a steerable anchor system fully deployed off the stern roller and prepared for release.

In FIG. 5, the anchor system 100 has cleared the stern roller 123 and is hanging free below the stern of the AHV 200. The AHV's navigation system may be checked at this point to ensure that the anchor system 100 is located directly above the selected target location 301 on the seafloor 300. In those embodiments where anchor system 100 includes an internal control system configured to determine absolute location of anchor system 100 (e.g., such as an internal control system having global positioning system GPS capabilities), the anchor system 100 may not have to be released precisely from the AHV 200 over the target location 301, but may be capable of adjusting for some horizontal offset as it falls toward the seafloor 300, depending on water depth.

Figure 6:
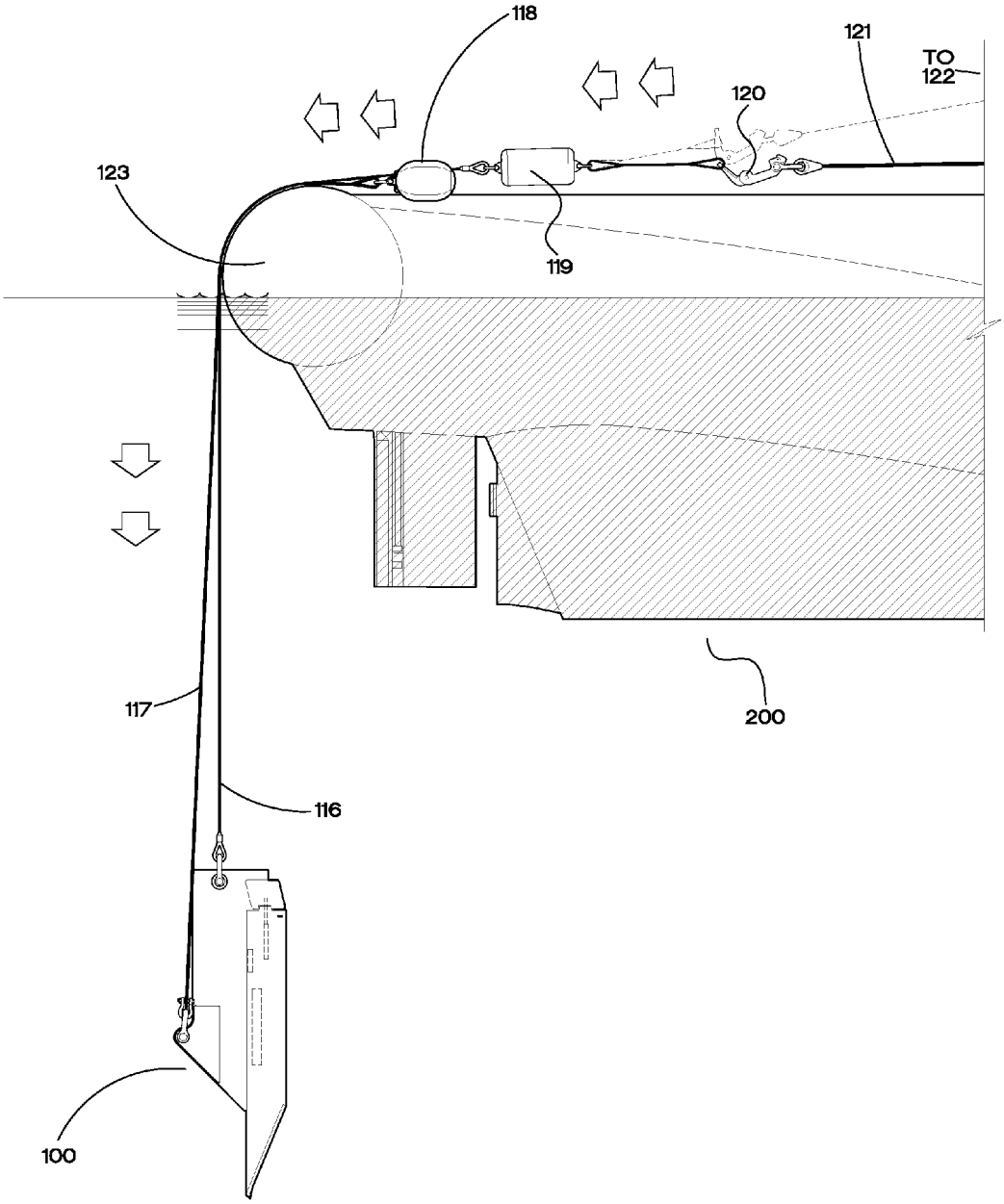
FIG. 6 illustrates a steerable anchor system at the moment of release as it commences free-fall.

In FIG. 6, the pelican hook 120 has been released by the deck crew and the anchor 100 has started downward free-fall toward the target location 301 on seafloor 300.

FIG. 7 illustrates descent of the steerable anchor system 100 through the water column showing how the active control system may use the control surfaces 105A and 105B to correct the downward path 301 of the anchor system 100 for varying currents and other anomalies. In particular, the free-fall of the anchor system 100 is depicted with potential deviations from the direct path to the target location 301 and resulting course corrections made by the internal control system (e.g., within capsule 109) operating the control surfaces 105A and 105B. Such deviations from a straight path may result from sea currents or anomalies (e.g., hydrodynamic imbalances) in the construction of the anchor body of system 100. As shown, at the end of the free-fall period (i.e., at the terminal end of a downward path depicted by line 302), the anchor 100 must penetrate the seafloor 300 sufficiently to embed the complete length of the anchor body in the seafloor 300 to allow subsequent successful drag embedment operations, otherwise the anchor system 100 will need to be retrieved and re-set. In one exemplary embodiment, at the end of its decent the steerable anchor system 100 at a minimum penetrates the seafloor 300 such that the whole length of the steerable anchor system 100 is below the level of seafloor 300. This ensures that later tensioning of the mooring line will cause the steerable anchor system 100 to dive to deeper equilibrium depth. Further shown in an inset box of FIG. 7 is a vessel to be moored in the form of a MODU 400 that is optionally floating nearby on the same sea surface as AHV 200, with a mooring line 128 attached to MODU 400 for mooring in a manner as described further herein. MODU 400 is shown in inset box of FIG. 7 for purposes of scale. Alternatively, it will be understood that a vessel to be moored may be moved in later, and does not have to be present in the area during the placement of anchor system 100 into the sea floor.

The initial penetration depth of an anchor system 100 into seafloor 300 is a function of the anchor's kinetic energy just prior to impact with the seafloor 300. A higher impact velocity gives a higher kinetic energy and, therefore, a deeper penetration depth. Reducing the anchor's drag coefficient is one means of increasing the impact velocity. Careful attention to the anchor's shape and geometry may be used to reduce the anchor's drag coefficient but alternative means originally developed for boat and ship hulls, such as the use of bubble curtains, may also be adapted for use with the disclosed steerable anchor systems. Bubble curtains are a mixture of micro air (or other gas) bubbles and water injected adjacent to the hull surface in order to reduce friction between the hull and the water.

As further shown in FIG. 7, ROV 124 may first visually check for penetration depth of anchor system 100, once steerable anchor system 100 has penetrated the seafloor 300. Distance marks optionally provided on the recovery pendant 116 may also be used to estimate anchor penetration. If a navigational data link is provided, the ROV 124 may approach the submersible recovery buoy 119 and download or otherwise recover the initial anchor installation (penetration and/or orientation) data as previously described herein, e.g., via electrical or optical signals transmitted through a suitable data transmission media or data link that extends through the recovery pendant line 116 to an optical or acoustic I/O interface (e.g., modem) provided on the recovery buoy 119 for communicating with I/O signal circuitry of the ROV; by physical retrieval of a control system capsule from the embedded anchor system 100; by visually reading the anchor installation/penetration information from a display device of the submersible recovery buoy 119; by receiving navigational data across a direct physical data path connection from a control system of the anchor system 100 via subsea data connectors that couple the ROV circuitry to an electrical or optical signal data transmission line that extends from a control system in the anchor system; etc. If based on the retrieved navigational data the anchor penetration depth is determined to be inadequate at this time, the AHV 200 may recover the anchor system 100 and re-deploy it.

Figure 8:
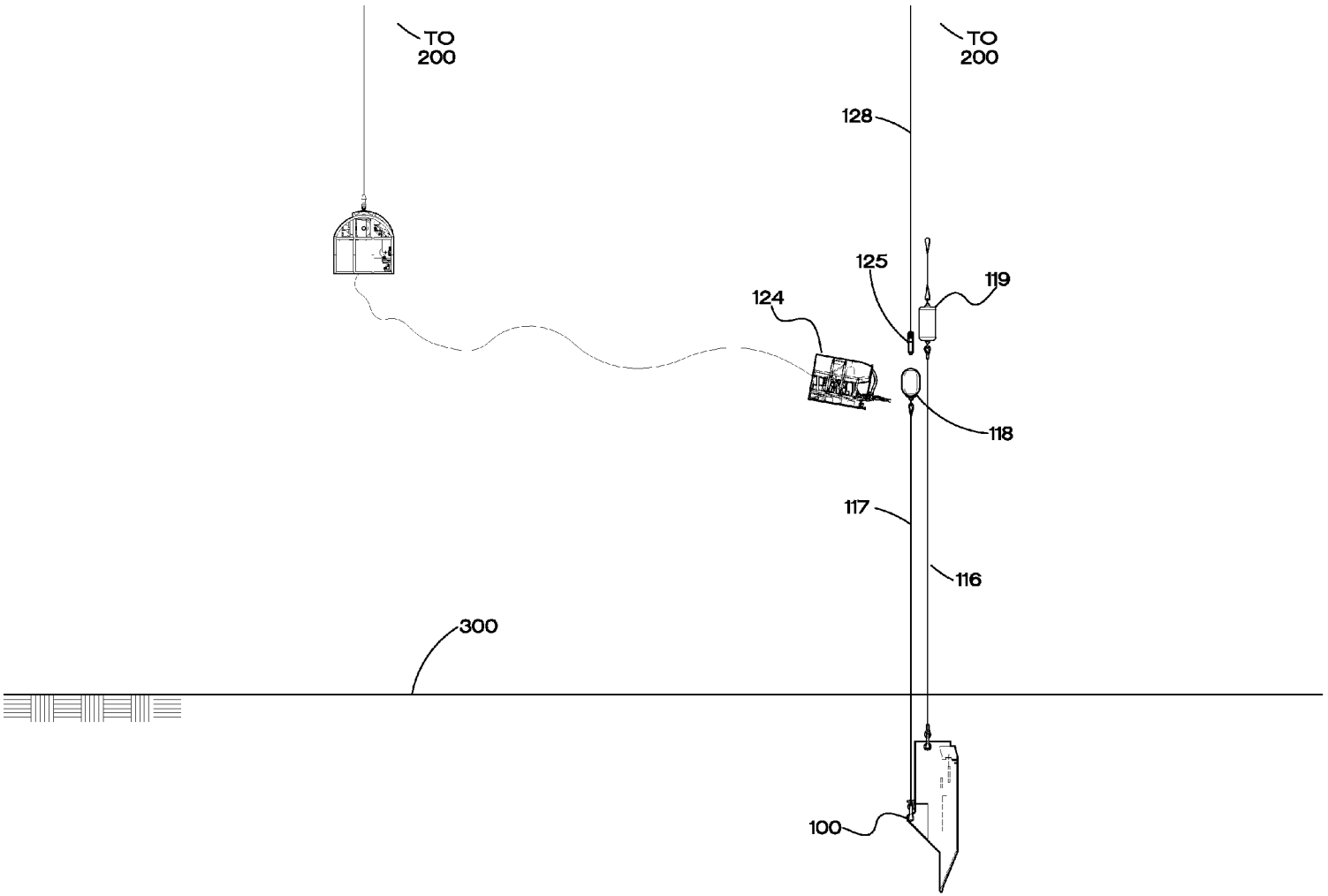
FIG. 8 illustrates a mooring line outfitted with a subsea connector being lowered by an AHV (or other installation vessel) to connect to an anchor mooring pendant of an embedded steerable anchor system according to one exemplary embodiment of the disclosed systems and methods.

In FIG. 8, the AHV 200 is shown lowering a subsea connector 125 on mooring line 128. With the assistance of ROV 124, the subsea connector 125 on mooring line 128 may be docked into the subsea connector receptacle 118.

Figure 9:
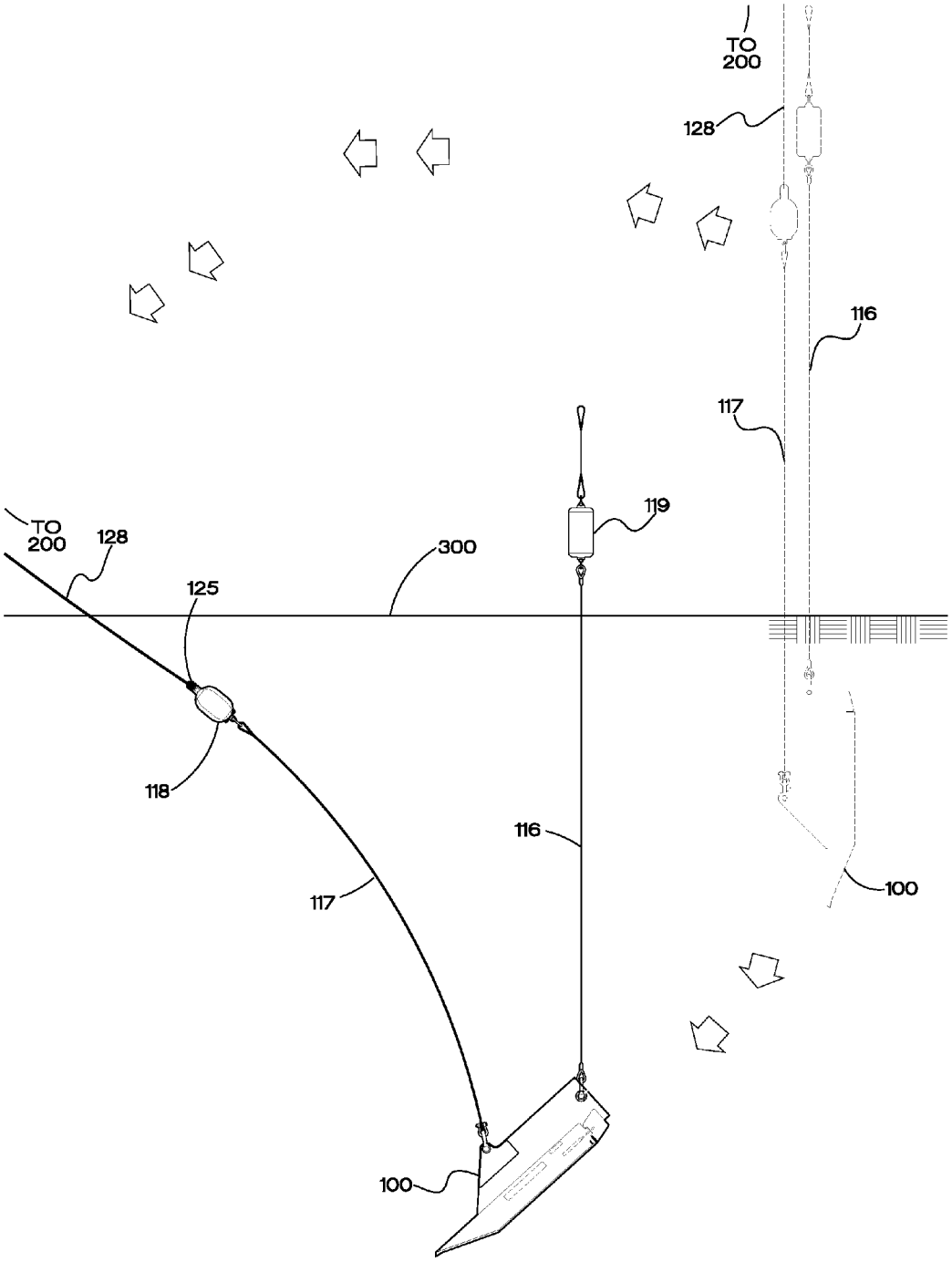
FIG. 9 illustrates the mooring line of FIG. 8 being moved towards the center of a mooring pattern by an AHV (or other installation vessel) after connecting to the anchor mooring pendant to cause the steerable anchor system to dive into the seafloor to its final design penetration depth according to one exemplary embodiment of the disclosed systems and methods.
Figure 10A:
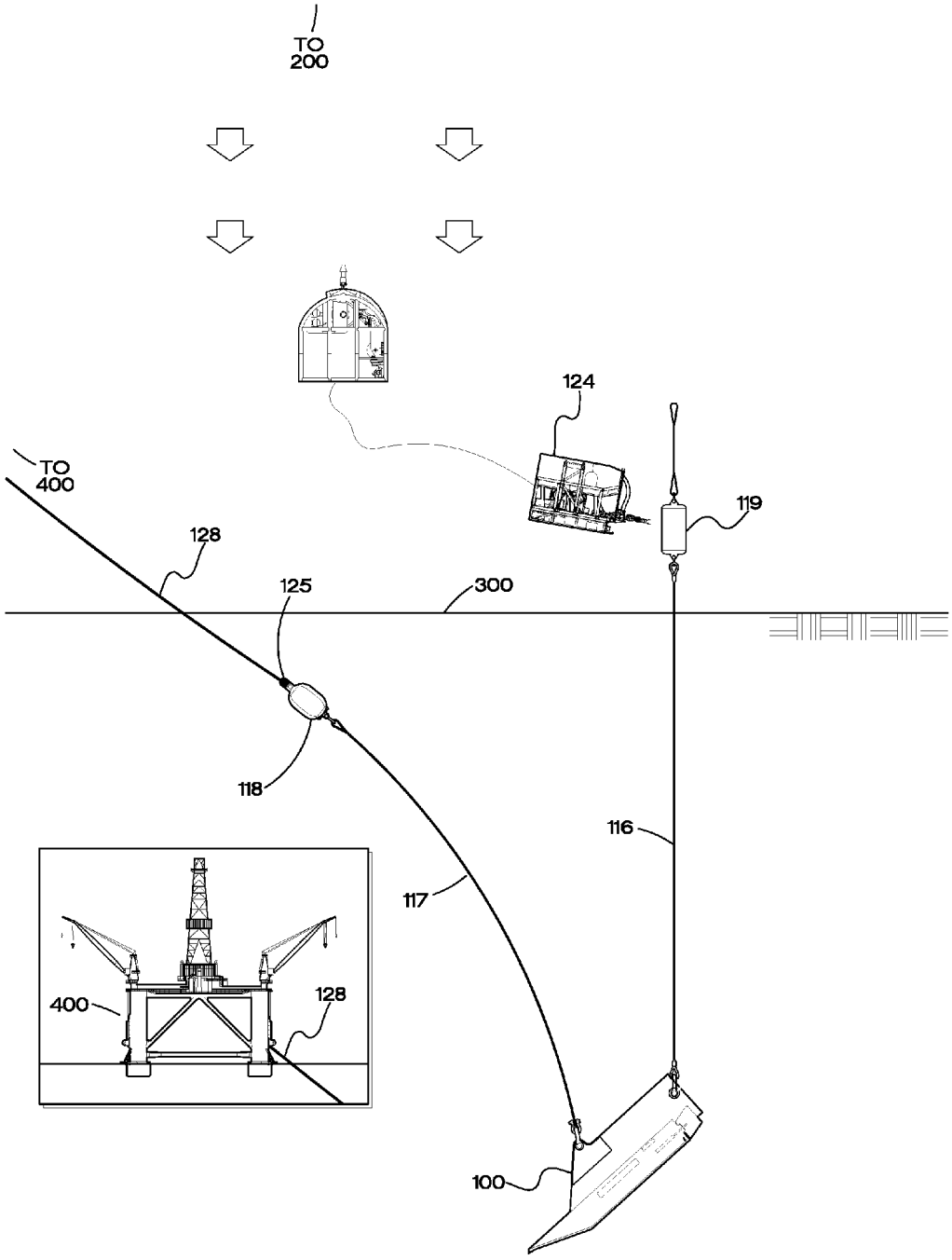
FIG. 10A illustrates the AHV's ROV querying a control system of the steerable anchor system for depth and orientation information according to one exemplary embodiment of the disclosed systems and methods.
Figure 10B:
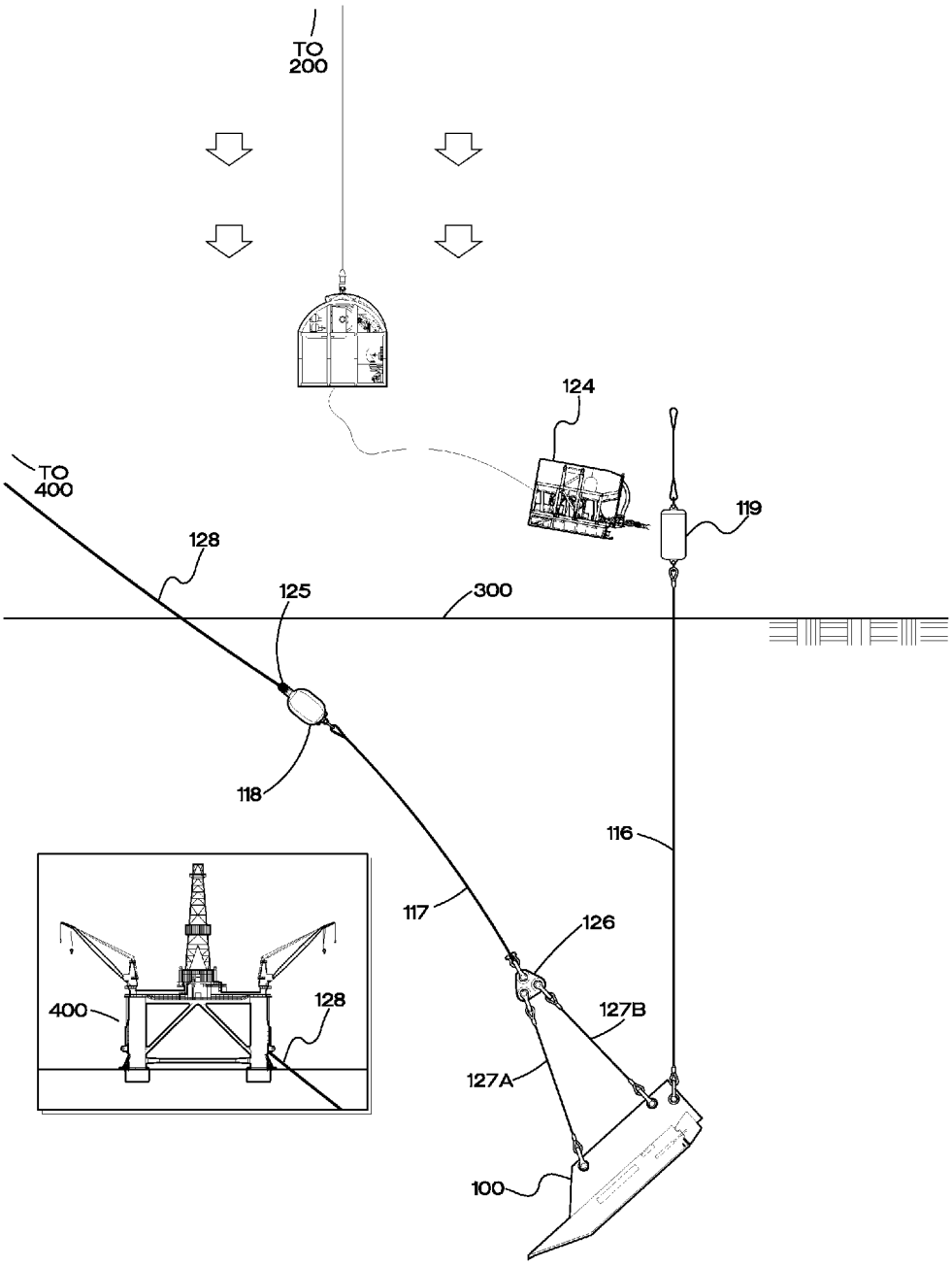
FIG. 10B illustrates the AHV's ROV querying a control system of the steerable anchor system for depth and orientation information according to one exemplary embodiment of the disclosed systems and methods.

In FIG. 9 the AHV 200 has moved together with the mooring line 128 towards the center of the mooring pattern, cutting the mooring pendant 117 into the seafloor 300 and causing the anchor 100 to dive and penetrate towards its final penetration depth as shown in FIG. 10A (and in the alternate embodiment of FIG. 10B). In FIGS. 10A and 10B, the top or upper end of mooring line 128 has been handed over at the surface to MODU 400 floating on the sea surface that is to be moored with the anchor 100 that was pulled to depth by AHV 200 in FIG. 9. For purposes of scale, MODU 400 is shown floating on the sea surface in an inset box of each of FIGS. 10A and 10B, with the top or upper end of mooring line 128 coupled to MODU 400 to secure it to anchor system 100. The bottom or lower end of mooring line 128 is in turn coupled to mooring pendant 117 by subsea connector receptacle 118 as shown in each of FIGS. 10A and 10B.

In the embodiment of FIGS. 9 and 10A, the anchor 100 dives when the mooring line 128 is tensioned due to the geometry of the mooring pendant line attachment pad-eye 102 relative to the anchor's center of soil pressure for the embodiment of FIG. 10A, or dives due to the geometry of the assembled triplate 126 and anchor bridle 127A and 127B for the embodiment of FIG. 10B. In the embodiment of FIG. 10B, a mooring bridle and triplate assembly is connected between anchor 100 and the mooring pendant line 117, i.e., mooring pendant line 117 is connected via triplate 126 by attachment of anchor bridle 127A and 127B to multiple mooring pendant bridle attachment pad-eyes 102A and 102B, which are defined in center plate 101 that is configured for operable attachment to mooring pendant anchor bridle parts 127A and 127B as shown. Also shown is the mooring bridle and triplate assembly 115 which is connected to the mooring pendant line 117.

As shown in the embodiments of FIGS. 10A and 10B, the ROV 124 deployed from AHV 200 may re-query the control system within the capsule 109 at the recovery buoy 119 to confirm that the final penetration depth and anchor orientation is acceptable. If the final penetration depth is not acceptable, the AHV 200 recovers the anchor and re-deploys it. At this point, the AHV 200 has connected the mooring line to the vessel to be moored as shown in inset of each of FIGS. 10A and 10B. In this case, a mobile offshore drilling unit (MODU) 400 is the vessel to be moored, although the disclosed systems and methods may be employed for anchoring and mooring a wide variety of other types of vessels, e.g., drilling and other types of ships, naval vessels, oil tankers, etc.

Figure 11:
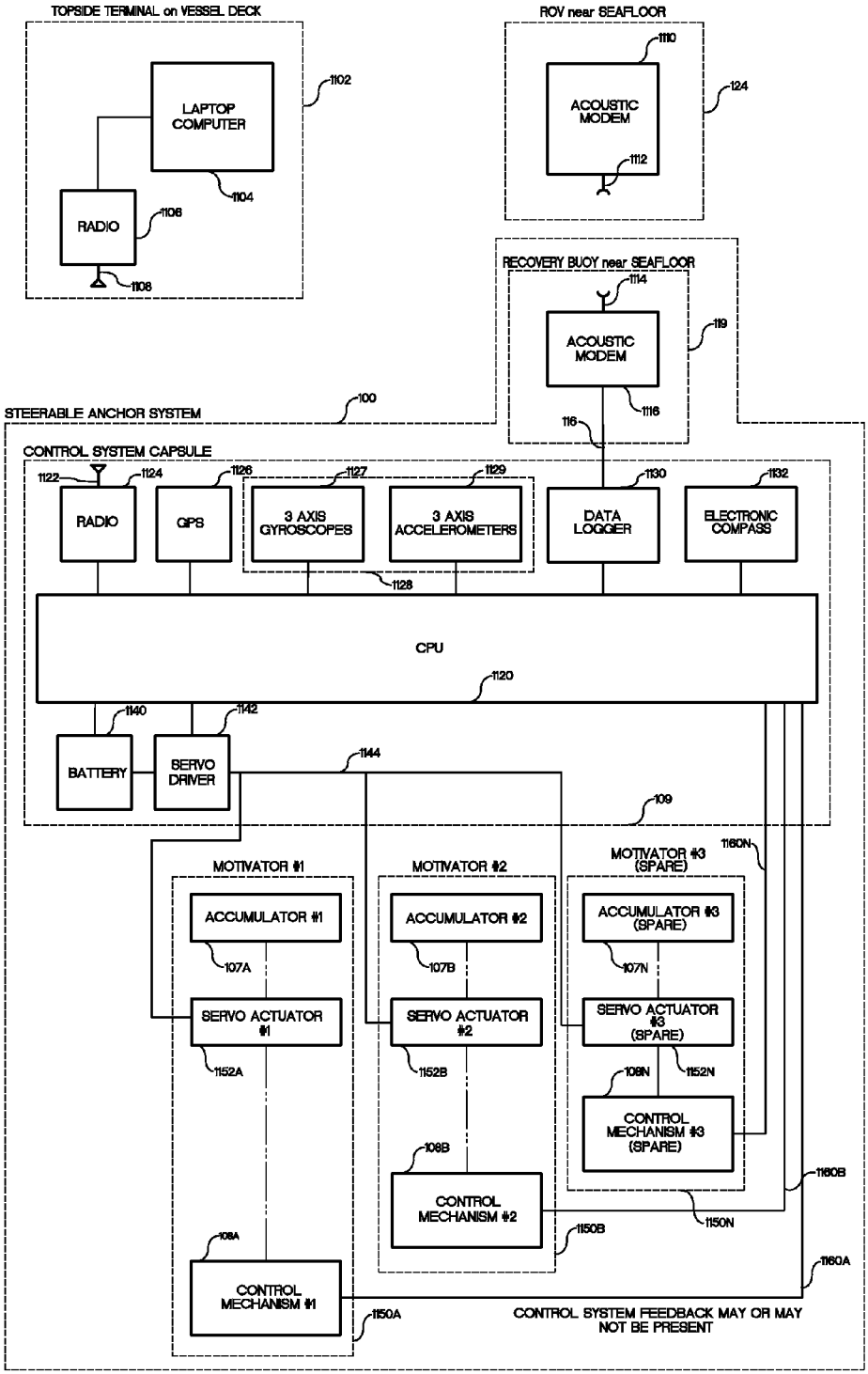
FIG. 11 illustrates a block diagram of an anchor system, ROV and topside operator terminal according to one exemplary embodiment of the disclosed systems and methods.

FIG. 11 illustrates a simplified block diagram showing one exemplary embodiment of active components of a steerable anchor system 100 coupled via a data transmission path through recovery line 116 to a recovery buoy 119 that is configured with an acoustic modem 1116 and acoustic transducer 1114. In this regard, recovery buoy 119 and its data transmission line/recovery line 116 may be provided as optional components of the steerable anchor system 100. Also shown in FIG. 11 is an acoustic modem 1110 and acoustic transducer 1112 that are provided on board ROV 124. In FIG. 11, ROV 124 is illustrated in proximity to recovery buoy 119 such that acoustic signals representative of navigational data may be transmitted from acoustic modem 1116 via transducer 1114 of buoy 119 to acoustic modem 1110 via transducer 1112 of ROV 124 in a manner as described above. It will be understood that FIG. 11 is exemplary only, and that recovery buoy 119 and ROV 124 may be alternatively configured with suitable optical and/or visual communication components (e.g., such as a display device replacing modem 1116 on buoy 119 and a video camera replacing modem 1112 on ROV 124) for communicating navigational data from buoy 119 to ROV 124 using other types of signals, such as optical signals or displayed and captured visual images in those manners described elsewhere herein. It will also be understood that other possible components of ROV 124 and buoy 119 are not shown that may be present to implement operations of ROV 124 and buoy 119 described elsewhere herein. Examples of such other components include, but are not limited to, battery or batteries, memory device/s, processing device/s, ROV propulsion and communication lines via ROV umbilical cord to surface, etc.

Also shown in FIG. 11 is topside operator terminal 1102, which in this case is provided in the form of a laptop computer 1104, e.g., such as Windows, Linux or Apple OS-based computer having internal host processing device (e.g., Intel or AMD CPU), video display, storage, random access memory (RAM), keyboard, touchpad or mouse, etc. However, any other suitable operator terminal system may be employed, e.g., such as desktop computer, tablet computer, smart phone, etc. As shown topside operator terminal 1102 may also include a radio frequency (RF) radio system (e.g., Bluetooth or 802.11-based radio system) that includes a RF transceiver coupled to an RF antenna 1108. Topside terminal 1102 may be utilized by a human operator on deck of a surface installation vessel 200 such as illustrated and described elsewhere herein, e.g., to communicate with anchor system 100 via radio 1106 and antenna 1108 to activate and/or initialize components of system 100 as described in relation to FIG. 3, and/or to wirelessly retrieve data or otherwise configure or run tests/diagnostics on one or more components of anchor system 100. It will be understood that communication between a topside operator terminal and an anchor system 100 may alternatively be accomplished in any other suitable manner while anchor system 100 is on deck of surface vessel 200, e.g., such as wired data communications through Ethernet cable, etc.

Still referring to FIG. 11, steerable anchor system 100 may be configured as shown with an optional waterproof control system capsule 109 (e.g., an environmentally sealed waterproof enclosure) that may be, for example, detachable and retrievable from anchor system 100 as previously described herein. Alternatively, a non-capsulated control system having similar components may be provided integral to an anchor system 100. As shown in FIG. 11, control system components (e.g., within capsule 109) may include a RF radio system 1124 including a RF transceiver, and a coupled RF antenna 1122 that may be configured to provide communication between an anchor system processing device 1120 (e.g., CPU, microcontroller, controller, etc.) and external equipment such as topside operator terminal 1102 while anchor system 100 is on deck of installation vessel 200.

As shown in FIG. 11, other components (e.g., within control system capsule 109) that may be operatively coupled to anchor system processing device 1120 include GPS module 1126 that may be employed to determine absolute location of anchor system 100 prior to release as described in relation to FIG. 5. Also shown coupled to anchor system processing device 1120 are components of inertial navigation system 1128, which in this exemplary embodiment include 3-axis gyroscopes 1127 and 3-axis accelerometers 1129. Components of inertial navigation system 1128 may be employed in a manner described elsewhere herein to control descent path of anchor system 100 via anchor system processing device 1120 and motivator systems 1150 as described further below. An optional electronic compass 1132 may also be provided as shown to monitor directional orientation of anchor system 100. A data logger 1130 (e.g., including one or more of non-volatile memory, Flash or EEPROM memory, volatile memory, etc.) may be coupled to receive and store navigation data for transmittal and/or retrieval by ROV 124 in a manner as previously described. FIG. 11 also illustrates control system power source 1140, e.g., one or more batteries 1140 provided to power anchor system processing device 1120 and its coupled electronic components, as well as to provide power to servo driver 1142 that is coupled as shown to provide power signals 1144 to selectably actuate individual server actuators 1152A, 1152B and 1152N of motivators 1150 under the control of anchor system processing device 1120 in a manner described further below.

In one exemplary embodiment, control system components (e.g., within capsule 109) may be provided with memory (e.g., non-volatile memory, Flash memory, etc.) that includes navigational reference data that may be provided in the form of a grid of location coordinates (e.g., longitude and latitude or other suitable geographic positioning coordinates), as well as a stored target location on the seafloor 300 and/or a pre-defined anchor path from the surface location to the seafloor. When optional GPS module 1126 is present, processing device 1120 of the control system (e.g., within capsule 109) may be configured to determine initial GPS-based location coordinates of anchor system 100 on the stored location grid prior to anchor system release based on location data provided above the surface of the water by GPS module 1126, and to optionally calculate a pre-determined anchor path from the initial anchor location to the target seafloor location. After release of anchor system 100, processing device 1120 may then be configured to use inertial-based navigation data from inertial navigation system 1128 to track and update the real time location of anchor system 100 on the stored location grid as the anchor system descends through the water to the seafloor 300. Processing device 1120 of a control system may also be configured in one exemplary embodiment to compare the real time actual path of anchor system toward the seafloor 300 against a stored pre-defined path or a pre-determined anchor path to determine the desired real time output position of each of the control surfaces 105 to guide the anchor to a target location in the seafloor along the pre-defined or pre-determined anchor path.

In another exemplary embodiment, a control system (e.g., within capsule 109) may be programmed with initial offset or error information that represents the distance and heading that anchor system 100 needs to traverse (or minimize) to reach a given target location on seafloor 300 (e.g., without anchor system 100 being required to know its absolute geographic starting position from GPS data). For example, "50 feet North" may be programmed to indicate heading and distance that anchor system 100 needs to traverse from its starting point to the seafloor, or "0 feet" (dead center) to indicate that the starting point is directly over the target seafloor location and that anchor system 100 needs to dive straight down from its starting point to the seafloor 300. This programmed error information may be provided to processing device 1120 of the control system (e.g., within capsule 109), for example, as data entered by an operator from topside operator terminal 1120 during system initialization on the deck of an installation vessel 200. During anchor system descent, processing device 1120 may then utilize real time navigational data sensed by gyroscopes 1127 and accelerometers 1129 of inertial navigation system 1128 to control movement of control surfaces 105 in real time as necessary to minimize the error offset so that anchor system 100 penetrates the seafloor 300 as close as possible to the target seafloor location. It will be understood that any other suitable control technique may be implemented by on-board control system components (e.g., within capsule 109) to self-direct anchor system 100 to a target location.

In the illustrated embodiment of FIG. 11, two motivator systems 1150A and 1150B are shown provided that are mechanically coupled to controllably move respective control surfaces 105A and 105B during free fall descent of anchor system 100 to control (steer) the anchor system descent trajectory and/or path. One or more additional (spare) motivator systems 1150N may be provided to controllably operate and move additional optional control surfaces, such as a movable rudder (not shown). In the illustrated embodiment, each of motivator systems includes an energy source in the form of a respective accumulator 107 that may contain pressurized fluid for selectably actuating a respective control mechanism 108 (e.g., such as pneumatic or hydraulic piston and cylinder) coupled to each control surface 105 under the control of a respective servo actuator 1152 (e.g., pneumatic or hydraulic electro-mechanical valve) that is actuated in a single step between on and off (or alternatively adjusted in continuous manner or in small steps between on and off positions) to selectably provide and withhold pressurized fluid to each control mechanism 108 to move a respective control surface 105 in response to individual power signals 1144 provided by servo driver 1142 under the direction of anchor system processing device 100 based on navigational and positional input received from inertial navigation system 1128, GPS 1126, and/or electronic compass 1132. In this regard, anchor system processing device 100 may be programmed to execute navigational algorithm/s that are stored and loaded from on-board non-volatile memory, to determine how to move each of control systems 105 based on real time navigational data from inertial navigation system 1128, GPS 1126, and/or electronic compass 1132. Also shown in FIG. 11 are optional respective control system feedback paths 1160 that may be provided to communicate real time sensed position of each control mechanism 108 (and therefore real time position of each respective control surface 105) from suitable sensors (e.g., position sensors, proximity sensors, etc.) to anchor system processing device 1120, which may use this sensed feedback position to correct and/or fine tune control movement of each control surface 105 to achieve the desired anchor system descent path.

It will be understood that the illustrated embodiment of FIG. 11 is exemplary only, and that any other configuration and/or type of actuation components may be employed to move control surfaces 105 under the direction of an anchor system processing device, e.g., such as electro-mechanical actuators (i.e., rather than pneumatic or hydraulic actuation components) that are coupled to selectably move each of control surfaces 105 to control the descent path of a free-falling anchor system. Moreover, the particular arrangement and/or identity of components within a control system or control system capsule 109 may vary as desired or needed to fit the needs of a given application, e.g., additional or alternative components may be present, and/or radio 1124, antenna 1122, compass 1132, etc. may be absent or replaced by different components.

It will also be understood that one or more of the tasks, functions, or methodologies described herein (e.g., including those performed by control system components (e.g. within capsule 109), ROV 124, topside terminal system 1102, etc.) may be implemented by circuitry and/or by a computer program of instructions (e.g., computer readable code such as firmware code or software code) embodied in a non-transitory tangible computer readable medium (e.g., optical disk, magnetic disk, non-volatile memory device, etc.), in which the computer program comprising instructions are configured when executed (e.g., executed on a processing device of an information handling system such as CPU, controller, microcontroller, processor, microprocessor, FPGA, ASIC, or other suitable processing device) to perform one or more steps of the methodologies disclosed herein. A computer program of instructions may be stored in or on the non-transitory computer-readable medium accessible by an information handling system for instructing the information handling system to execute the computer program of instructions. The computer program of instructions may include an ordered listing of executable instructions for implementing logical functions in the information handling system. The executable instructions may comprise a plurality of code segments operable to instruct the information handling system to perform the methodology disclosed herein. It will also be understood that one or more steps of the present methodologies may be employed in one or more code segments of the computer program. For example, a code segment executed by the information handling system may include one or more steps of the disclosed methodologies.

While the invention may be adaptable to various modifications and alternative forms, specific examples and exemplary embodiments have been shown by way of example and described herein. However, it should be understood that the invention is not intended to be limited to the particular forms disclosed. Rather, the invention is to cover all modifications, equivalents, and alternatives falling within the spirit and scope of the systems and methods described herein. Moreover, the different aspects of the disclosed systems and methods may be utilized in various combinations and/or independently. Thus the invention is not limited to only those combinations shown herein, but rather may include other combinations.

What is claimed is:

1. A method for installing one or more anchor systems in a seafloor underlying a body of water, comprising:

providing at least one steerable anchor system from an installation vessel on the water surface, the steerable anchor system comprising:

an embeddable anchor body configured to moor a sea surface vessel to the seafloor from an embedded position below the seafloor, one or more steering system components, and an on-board control system having at least one processing device coupled to control the steering system components;

allowing the steerable anchor system to free fall through the water toward the seafloor to cause the embeddable anchor body to impact and penetrate to a position completely embedded below the seafloor such that the entire embeddable anchor body is below the level of seafloor; and using the on-board control system to control the steering system components to alter the descent path of the anchor system to steer the anchor system to a target location on the seafloor.

2. The method of claim 1, where the anchor body is a plate anchor body having at least two flukes that extend outwardly from opposing sides of the anchor body.

3. The method of claim 1, where the steering system components comprise at least one of control surfaces, thrusters, or a combination thereof.

4. The method of claim 1, where the anchor system further comprises a mooring pendant line coupled to the anchor body; and where the method further comprises connecting the mooring pendant line to a mooring line after the anchor body impacts and penetrates to the position completely embedded below the sea floor.

5. The method of claim 4, further comprising attaching a vessel floating on the sea surface to the mooring line to moor the vessel to the embedded anchor system; and later detaching the moored vessel and recovering the anchor system from beneath the seafloor after the departure of a moored vessel.

6. The method of claim 4, further comprising tensioning the mooring line to drag embed the anchor body to deeper depth below the seafloor in order to increase its holding capacity.

7. The method of claim 6, where the steerable anchor system comprises a combination of anchor body shape, stabilizing fin configuration, control surface configuration and line configuration that is such that the anchor body is configured to dive within the sea floor to a new force equilibrium depth further below the sea floor when the mooring line is tensioned.

8. The method of claim 1, where the steering system components comprise control surfaces; where the steerable anchor system further comprises one or more electro-mechanical actuators mechanically coupled to control the control surfaces; and where the method further comprises using the on-board control system to control the electro-mechanical actuators to move the control surfaces as the anchor system free falls through the water to control the trajectory or path of descent of the anchor system and steer the anchor system to the target location on the seafloor.

9. The method of claim 1, where the steering system components comprise control surfaces; where the steerable anchor system further comprises one or more hydraulic or pneumatic actuators mechanically coupled to control the control surfaces; and where the method further comprises using the on-board control system to control the hydraulic or pneumatic actuators to move the control surfaces as the anchor system free falls through the water to control the trajectory or path of descent of the anchor system and steer the anchor system to the target location on the seafloor.

10. The method of claim 9, where the steerable anchor system further comprises a controllable energy source that is coupled to provide hydraulic or pneumatic energy to cause the hydraulic or pneumatic actuators to move the control surfaces.

11. The method of claim 1, where the on-board control system includes a gyroscopic inertial navigation component coupled to the control system processing device; and where the method further comprises using the on-board control system to control the steering system components to control the trajectory or path of descent of the anchor system and steer the anchor system to the target location on the seafloor based at least in part on navigational data provided from the gyroscopic inertial navigation component.

12. The method of claim 1, where the on-board control system includes a gyroscopic inertial navigation component coupled to the control system processing device; and where the method further comprises using the processing device of the on-board control system to:

use an initial release location of the anchor system on a coordinate grid to determine a required anchor descent path to target location on the seafloor;

compare the actual descent path of the anchor system to the seafloor on the coordinate grid against the required anchor descent path to the seafloor on the coordinate grid; and determine the desired output position of the control surfaces to guide the anchor to the target location in the seafloor based on the comparison of the actual descent path of the anchor system to the seafloor on the coordinate grid against the required anchor descent path to the seafloor on the coordinate grid.

13. The method of claim 12, where the on-board control system further comprises a GPS system; and where the method further comprises using the processing device of the control system to determine the initial grid coordinates of the anchor system based on GPS location information provided by the GPS system.

14. The method of claim 12, where the on-board control system is contained within an enclosure that isolates the on-board control system from ambient water, soil particles and hydrostatic pressures experienced at the seafloor.

15. The method of claim 12, where the on-board control system further comprises a data logger coupled to the processing device of the on-board control system and configured to store or maintain anchor penetration data and anchor orientation data; where the steerable anchor system further comprises a recovery buoy communicatively coupled to the data logger of the on-board control system; and where the method further comprises:

transmitting the anchor penetration data and anchor orientation data from the data logger to the recovery buoy following anchor installation while the anchor body is embedded in the seafloor with the recovery buoy floating above the seafloor; and recovering the transmitted anchor penetration and anchor orientation data from the recovery buoy following anchor installation.

16. The method of claim 15, where the recovery buoy is mechanically coupled to the anchor body by a recovery pendant, the recovery pendent including an electrical or optical data transmission path that communicatively couples the on-board control system to the recovery buoy; and where the method further comprises:

transmitting the stored anchor penetration and anchor orientation data from the data logger of the on-board control system via electrical or optical data communication signals through the data transmission path of the recovery pendant following anchor installation; and downloading the transmitted stored anchor penetration and anchor orientation data to a remotely operated vehicle (ROV) using at least one of electrical, visual or acoustical communication.

17. The method of claim 15, where the control system enclosure comprises a retrievable capsule; where the steerable anchor system further comprises a lanyard and floating buoy attached to the capsule that is configured to extend above the seafloor following anchor installation; and where the method further comprises using the lanyard to recover the control system capsule with the assistance of the ROV following anchor installation.

18. The method of claim 1, where the anchor body provides a location for electrical and mechanical components of the steerable anchor system that is configured to protect the electrical and mechanical components of the steerable anchor system from subsea and subsurface environments.

19. The method of claim 1, further comprising using a deployment system to suspend the anchor system a short distance below the water surface, and to release the anchor system to allow the anchor system to glide to the seafloor target location.

20. The method of claim 1, using a mooring pendant line configured with a subsea connector to attach a main mooring line to the anchor system.

21. A steerable anchor system, comprising: an embeddable anchor body configured to moor a sea surface vessel to the seafloor from an embedded position below the seafloor, one or more steering system components, and an on-board control system having at least one processing device coupled to control the steering system components; where the control system is configured to control the steering system components to alter the descent path of the anchor system to steer the anchor system to a target location on a seafloor when the anchor system is allowed to free fall through the water toward the seafloor.

22. The steerable anchor system of claim 21, where the anchor body is a plate anchor body having at least two flukes that extend outwardly from opposing sides of the anchor body.

23. The steerable anchor system of claim 21, where the steering system components comprise at least one of control surfaces, thrusters, or a combination thereof.

24. The steerable anchor system of claim 21, where the anchor system further comprises a mooring pendant line coupled to the anchor body.

25. The steerable anchor system of claim 21, where the anchor body is configured to drag embed below the seafloor when attached to a tensioned mooring line; and where the steerable anchor system comprises a combination of anchor body shape, stabilizing fin configuration, control surface configuration and line configuration that is such that the anchor body is configured to dive to a new force equilibrium depth when the mooring line is tensioned.

26. The steerable anchor system of claim 21, where the steering system components comprise control surfaces; where the steerable anchor system further comprises one or more electro-mechanical actuators mechanically coupled to control the control surfaces; and where the on-board control system is configured to control the electro-mechanical actuators to move the control surfaces as the anchor system free falls through the water to control the trajectory or path of descent of the anchor system and steer the anchor system to the target location on the seafloor.

27. The steerable anchor system of claim 21, where the steering system components comprise control surfaces; where the steerable anchor system further comprises one or more hydraulic or pneumatic actuators mechanically coupled to control the control surfaces; and where the on-board control system is configured to control the hydraulic or pneumatic actuators to move the control surfaces as the anchor system free falls through the water to control the trajectory or path of descent of the anchor system and steer the anchor system to the target location on the seafloor.

28. The steerable anchor system of claim 27, where the steerable anchor system further comprises a controllable energy source that is coupled to provide hydraulic or pneumatic energy to cause the hydraulic or pneumatic actuators to move the control surfaces.

29. The steerable anchor system of claim 21, where the on-board control system includes a gyroscopic inertial navigation component coupled to the control system processing device; and where the on-board control system is configured to control the steering system components to control the trajectory or path of descent of the anchor system and steer the anchor system to the target location on the seafloor based at least in part on navigational data provided from the gyroscopic inertial navigation component.

30. The steerable anchor system of claim 21, where the on-board control system includes a gyroscopic inertial navigation component coupled to the control system processing device; and where the processing device of the on-board control system is configured to:

use an initial release location of the anchor system on a coordinate grid to determine a required anchor descent path to target location on the seafloor;

compare the actual descent path of the anchor system to the seafloor on the coordinate grid against the required anchor descent path to the seafloor on the coordinate grid; and determine the desired output position of the control surfaces to guide the anchor to the target location in the seafloor based on the comparison of the actual descent path of the anchor system to the seafloor on the coordinate grid against the required anchor descent path to the seafloor on the coordinate grid.

31. The steerable anchor system of claim 30, where the on-board control system further comprises a GPS system; and where the processing device of the control system is configured to determine the initial grid coordinates of the anchor system based on GPS location information provided by the GPS system.

32. The steerable anchor system of claim 30, where the on-board control system is contained within an enclosure configured to isolate the on-board control system from ambient water, soil particles and hydrostatic pressures experienced at the seafloor.

33. The steerable anchor system of claim 30, where the on-board control system further comprises a data logger coupled to the processing device of the on-board control system and configured to store or maintain anchor penetration data and anchor orientation data; where the steerable anchor system further comprises a recovery buoy communicatively coupled to the data logger of the on-board control system; where the control system is configured to transmit the anchor penetration data and anchor orientation data from the data logger to the recovery buoy following anchor installation while the anchor body is embedded in the seafloor with the recovery buoy floating above the seafloor; and where the recovery buoy is configured to allow recovery of the transmitted anchor penetration and anchor orientation data from the recovery buoy following anchor installation.

34. The steerable anchor system of claim 33, where the recovery buoy is mechanically coupled to the anchor body by a recovery pendant, the recovery pendent including an electrical or optical data transmission path that communicatively couples the on-board control system to the recovery buoy; where the control system is configured to transmit the stored anchor penetration and anchor orientation data from the data logger of the on-board control system via electrical or optical data communication signals through the data transmission path of the recovery pendant following anchor installation; and where the recovery buoy is configured download the transmitted stored anchor penetration and anchor orientation data to a remotely operated vehicle (ROV) using at least one of electrical, visual or acoustical communication.

35. The steerable anchor system of claim 33, where the control system enclosure comprises a retrievable capsule; where the steerable anchor system further comprises a lanyard and floating buoy attached to the capsule that is configured to extend above the seafloor following anchor installation; and where the lanyard is configured to recover the control system capsule with the assistance of the ROV following anchor installation.

36. The steerable anchor system of claim 21, where the anchor body provides a location for electrical and mechanical components of the steerable anchor system that is configured to protect the electrical and mechanical components of the steerable anchor system from subsea and subsurface environments.

37. The steerable anchor system of claim 21, further comprising a mooring pendant line configured with a subsea connector to attach a main mooring line to the anchor system.

38. The method of claim 2, where the anchor body further comprises a vertical center plate that extends upwardly above the two opposing outwardly extending flukes; and where the two flukes each extend outwardly at a downward anhedral angle relative to a horizontal plane normal to the orientation of the center plate.

39. The method of claim 4, where the anchor body further comprises a vertical center plate that extends upwardly above the two opposing outwardly extending flukes and having an opening defined through the vertical center plate; where the anchor system further comprises the mooring pendant line coupled to the anchor body at the opening defined in the vertical center plate; and where the method further comprises:

connecting the mooring pendant line to a mooring line after the anchor body impacts and penetrates to the position completely embedded below the sea floor; and attaching a vessel floating on the sea surface to the mooring line to moor the vessel to the embedded anchor system.

40. The steerable anchor system of claim 22, where the anchor body further comprises a vertical center plate that extends upwardly above the two opposing outwardly extending flukes; and where the two flukes each extend outwardly at a downward anhedral angle relative to a horizontal plane normal to the orientation of the center plate.

41. The steerable anchor system of claim 24, where the anchor body further comprises a vertical center plate that extends upwardly above the two opposing outwardly extending flukes and having an opening defined through the vertical center plate; and where the anchor system further comprises the mooring pendant line coupled to the anchor body at the opening defined in the vertical center plate.

* * * * *